US009287603B2

(12) United States Patent
Komori et al.

(10) Patent No.: US 9,287,603 B2
(45) Date of Patent: Mar. 15, 2016

(54) ELECTRONIC DEVICE AND MODULE INSTALLED IN ELECTRONIC DEVICE

(75) Inventors: Kenji Komori, Kanagawa (JP); Takahiro Takeda, Kanagawa (JP); Sho Ohashi, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 160 days.

(21) Appl. No.: 13/984,076

(22) PCT Filed: Feb. 8, 2012

(86) PCT No.: PCT/JP2012/052883

§ 371 (c)(1),
(2), (4) Date: Aug. 7, 2013

(87) PCT Pub. No.: WO2012/111511

PCT Pub. Date: Aug. 23, 2012

(65) Prior Publication Data

US 2013/0328641 A1 Dec. 12, 2013

(30) Foreign Application Priority Data

Feb. 18, 2011 (JP) ..... 2011-033058

(51) Int. Cl.

| | |
|---|---|
| ***H01P 5/12*** | (2006.01) |
| ***H01P 3/12*** | (2006.01) |
| ***H01P 3/00*** | (2006.01) |
| ***H01Q 1/22*** | (2006.01) |
| ***H01Q 9/16*** | (2006.01) |

(52) U.S. Cl.

CPC .. *H01P 3/12* (2013.01); *H01P 3/00* (2013.01); *H01Q 1/2266* (2013.01); *H01Q 9/16* (2013.01)

(58) Field of Classification Search

CPC ..... H01P 3/12; H01P 5/10; H01P 11/001
USPC ..... 333/137, 248, 101, 108
See application file for complete search history.

(56) References Cited

U.S. PATENT DOCUMENTS

| | | | | |
|---|---|---|---|---|
| 4,251,817 | A * | 2/1981 | Kimura et al. | 342/175 |
| 5,307,342 | A * | 4/1994 | Georigiou et al. | 370/380 |
| 5,488,380 | A * | 1/1996 | Harvey et al. | 342/368 |

(Continued)

FOREIGN PATENT DOCUMENTS

| | | |
|---|---|---|
| CN | 101958733 A | 1/2011 |
| JP | 2003-179821 | 6/2003 |

(Continued)

OTHER PUBLICATIONS

Chinese Office Examination Report issued in connection with related Chinese Patent Application No. CN 201280008205.3 dated Aug. 22, 2014.

(Continued)

*Primary Examiner* — Dinh Le
(74) *Attorney, Agent, or Firm* — Dentons US LLP

(57) ABSTRACT

Provided is an electronic device including a high-frequency signal waveguide configured to transmit a high-frequency signal in a housing. An addition unit to which a communication device is able to be added is provided in the high-frequency signal waveguide. When a second module having a communication function is added to the addition unit and coupled to the high-frequency signal waveguide, data transmission is possible between the first module and the second module via the high-frequency signal waveguide.

17 Claims, 16 Drawing Sheets

(56) References Cited

U.S. PATENT DOCUMENTS

| | | | | |
|---|---|---|---|---|
| 7,715,715 | B2 * | 5/2010 | Gerstel et al. | 398/59 |
| 7,881,689 | B2 * | 2/2011 | Leblanc et al. | 455/300 |
| 2003/0194175 | A1 * | 10/2003 | Beshai | H04J 14/0241 385/24 |
| 2010/0074810 | A1 * | 3/2010 | Lee | 422/186.29 |
| 2011/0038282 | A1 | 2/2011 | Mihota et al. | |

FOREIGN PATENT DOCUMENTS

| | | |
|---|---|---|
| JP | 2003-324395 | 11/2003 |
| JP | 2006-190215 | 7/2006 |
| JP | 2008-099235 | 4/2008 |
| JP | 2008-131372 | 6/2008 |
| JP | 2011-022640 | 2/2011 |
| WO | WO/2011/019017 | 2/2011 |

OTHER PUBLICATIONS

Pozar, David M., Microwave Engineering (3rd edition), Publishing House of Electronics Industry, Marth, 2007, pp. 279-280.

* cited by examiner

< EMBODIMENT 1 >

(A) FIRST EXAMPLE (B) SECOND EXAMPLE

< EMBODIMENT 2 >

< EMBODIMENT 3 >

(A) FIRST EXAMPLE (B) SECOND EXAMPLE

< EMBODIMENT 4 >

(A) FIRST EXAMPLE (B) SECOND EXAMPLE

< EMBODIMENT 5 >
(A) FIRST EXAMPLE (B) SECOND EXAMPLE

< EMBODIMENT 6 >

(A) FIRST EXAMPLE (B) SECOND EXAMPLE (C) THIRD EXAMPLE

< MODIFIED EXAMPLES OF EMBODIMENT 6 >

(A) FIRST MODIFIED EXAMPLE (B) SECOND MODIFIED EXAMPLE (C) THIRD MODIFIED EXAMPLE

< FOURTH MODIFIED EXAMPLE OF EMBODIMENT 6 >

(A) BENT STATE (B) EXTENDED STATE

< EXAMPLE APPLICATION 1: PORTABLE PHONE >

< EXAMPLE APPLICATION 2: THROTTLE STRUCTURE >

< EXAMPLE APPLICATION 3: CRADLE >

(A) FIRST EXAMPLE (B) SECOND EXAMPLE (C) THIRD EXAMPLE

ELECTRONIC DEVICE AND MODULE INSTALLED IN ELECTRONIC DEVICE

TECHNICAL FIELD

Technology disclosed in this specification relates to an electronic device and a module installed in the electronic device.

BACKGROUND ART

In various electronic devices such as a digital video tape recorder (VTR) and a digital video disc or digital versatile disc (DVD) player, there is demand for easily implementing various configuration changes such as a combination configuration of modules within a device and a connection configuration with another electronic device.

For example, in JP 2003-179821A, technology for easily changing a function of a device and adding a device by transmitting data through wireless communication between two signal processing means without change of an internal wiring or connection of a signal cable has been proposed.

CITATION LIST

Patent Literature

Patent Literature 1: JP 2003-179821A

SUMMARY OF INVENTION

Technical Problem

In a technique disclosed in JP 2003-179821A, a high-frequency signal (wireless signal) emitted from a communication device is reflected by a member within the device, and there is inconvenience in data transmission.

It is desirable to provide technology capable of avoiding a problem due to reflection of a high-frequency signal emitted from a communication device by a member within a device, and easily implementing a configuration change of an electronic device.

Solution to Problem

According to a first aspect of the present disclosure, an electronic device includes a high-frequency signal waveguide which transmits a high-frequency signal, wherein an addition unit to which a communication device can be added is provided in the high-frequency signal waveguide. Each electronic device disclosed in the dependent claims of the electronic device according to the first aspect of the present disclosure prescribes a further specific advantageous example of the electronic device according to the first aspect of the present disclosure.

According to a second aspect of the present disclosure, there is provided a module capable of being mounted on the high-frequency signal waveguide of the electronic device according to the first aspect of the present disclosure, the module including a communication device and a transfer structure which causes a high-frequency signal emitted from the communication device to be coupled to the high-frequency signal waveguide of the electronic device. Each module disclosed in the dependent claims of the module according to the second aspect of the present disclosure prescribes a further specific advantageous example of the module according to the second aspect of the present disclosure.

Because the high-frequency signal emitted from the communication device is transmitted through the high-frequency signal waveguide, a problem due to reflection of the high-frequency signal emitted from the communication device is avoided. It is only necessary for the transfer structure, which has a function of transferring the high-frequency signal, to be arranged facing the high-frequency signal waveguide. A configuration change in the electronic device can be easily implemented.

Advantageous Effects of Invention

According to the electronic device according to the first aspect of the present disclosure and the module according to the second aspect of the present disclosure, it is possible to avoid a problem due to reflection of a high-frequency signal emitted from a communication device in a member within the device, and to easily implement a configuration change in the electronic device.

DESCRIPTION OF EMBODIMENTS

Figure 1:
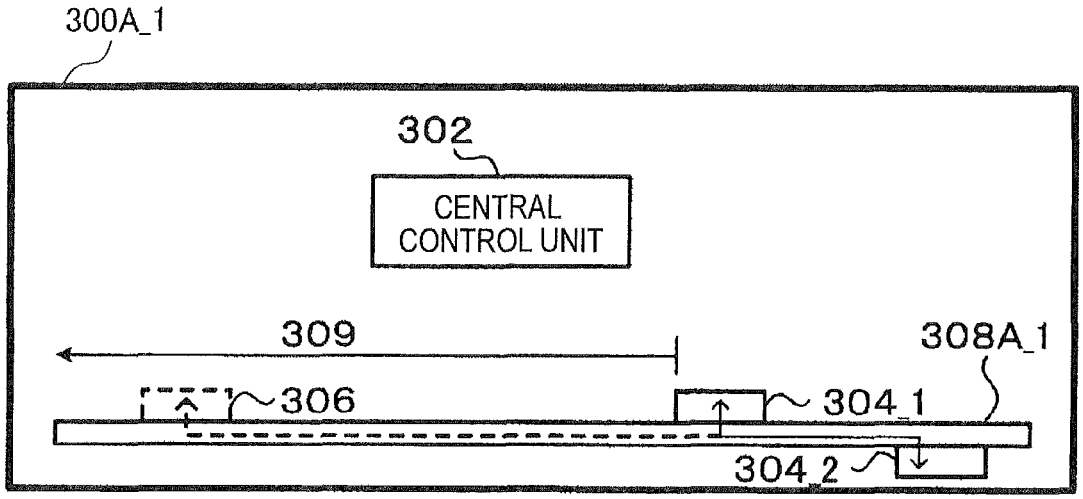
FIGS. 1(A) and 1(B) are diagrams illustrating an outline of the overall configuration of an electronic device of an embodiment 1 in which a signal transmission device of this embodiment is installed.
Figure 1:
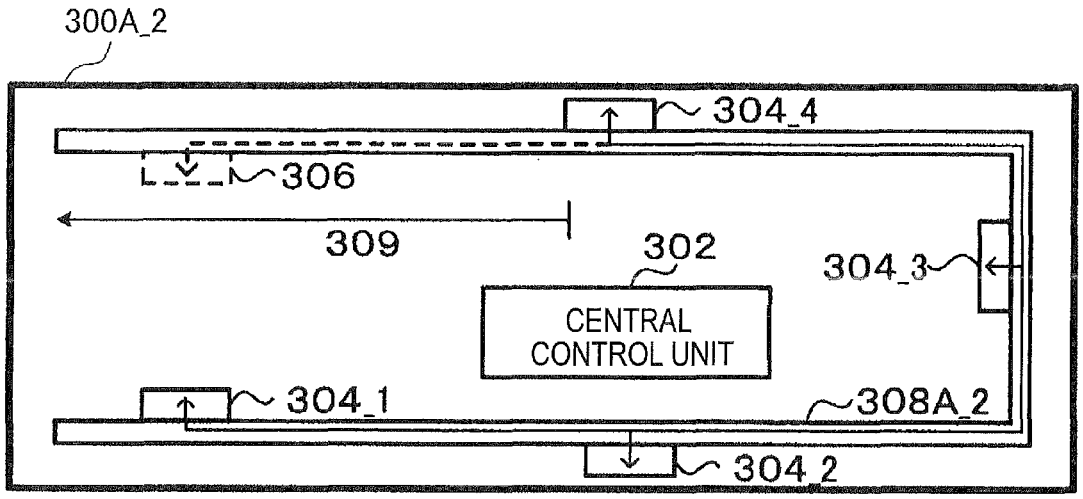

Hereinafter, embodiments of technology disclosed in this specification will be described in detail with reference to the drawings. When functional elements are distinguished from one another with respect to forms, the functional elements are distinguished by adding a reference character, "_n" (n: number), or a combination of these suffixes. On the other hand, when the functional elements are described without particular need to distinguish them from one another, such suffixes are omitted from the description. This also applies to the drawings.

Description will be given in the following order:

1. Overall outline
2. Embodiment 1: signal transmission within device (one high-frequency signal waveguide)
3. Embodiment 2: signal transmission within device (two high-frequency signal waveguides)
4. Embodiment 3: signal transmission within device (two high-frequency signal waveguides+connection)
5. Embodiment 4: (slot structure) between devices
6. Embodiment 5: (slot structure or flexible high-frequency signal waveguide) between devices
7. Embodiment 6: (cradle) between devices
8. Example Application <Overall Outline>

[Electronic Device and Module]

First, basic particulars will be described hereinafter. In the electronic device and the module disclosed in this specification, for example, a high-frequency signal waveguide made of a dielectric or magnetic material is arranged within a housing and a module with a communication function is mounted on the high-frequency signal waveguide, so that communication of a high-frequency signal transmitted through the high-frequency signal waveguide is established. Thereby, for high-speed data transmission, intra-device communication or inter-device communication is implemented by reducing multipath, transmission degradation, unnecessary radiation, and the like. By additionally mounting a module having a communication function in a high-frequency signal waveguide, it can be performed without burdens, such as design change, increase in a substrate area, and increase in cost, associated with a configuration change such as a functional extension. That is, a high-frequency signal waveguide capable of transmitting electromagnetic waves such as millimeter waves with low loss is arranged within a device and a module having a communication function is placed, if necessary, so that data transmission between an existing module and an added module is implemented by transmitting electromagnetic waves such as millimeter waves through the inside of the high-frequency signal waveguide. It is possible to add a module without making a design change in a main board or the like due to a configuration change, such as function addition.

In the arrangements of a high-frequency signal waveguide and a coupler (a transfer structure having a function of transferring a high-frequency signal) for connection of electrical wiring, a significant degree of error (several millimeters to several centimeters) can be allowed without specifying the pin arrangement or the contact position as in a connector of the electrical wiring. Because loss of electromagnetic waves can be reduced for a wireless connection, it is possible to reduce power of a transmitter, simplify a configuration of a reception side, and suppress interference of radio waves from outside of a device or reverse-radiation to the outside of the device.

For example, an electronic device of this embodiment corresponding to the electronic device according to the first aspect of the present disclosure includes a high-frequency signal waveguide which transmits a high-frequency wave signal. In the high-frequency signal waveguide, an addition unit to which a communication device can be added is provided in the high-frequency signal waveguide. A module of this embodiment in which a high-frequency signal can be coupled to the high-frequency signal waveguide of the electronic device of this embodiment includes a communication device and a transfer structure which couples the high-frequency signal emitted from the communication device to the high-frequency signal waveguide of the electronic device. Because the high-frequency signal emitted from the communication device is transmitted through the high-frequency signal waveguide, the high-frequency signal emitted from the communication device is not reflected by a member within the device. It is possible to easily deal with a configuration change, such as function addition by arranging the transfer structure having the function of transferring the high-frequency signal to face the high-frequency signal waveguide.

In the module of this embodiment, preferably, the high-frequency signal waveguide, which transmits the high-frequency signal, may be included. The communication device is arranged so that the high-frequency signal can be coupled to the high-frequency signal waveguide. In this case, the high-frequency signal emitted from the communication device is transmitted to the transfer structure through the high-frequency signal waveguide. Alternatively, the communication device and the transfer structure may be embedded in a semiconductor chip. Further, the semiconductor chip in which the communication device and the transfer structure are embedded may be mounted in the high-frequency signal waveguide.

For example, a first module having the communication function is coupled to the high-frequency signal waveguide. In this state, further, a second module having the communication function, for example, is added as a module for a configuration change in the addition unit, and is coupled to the high-frequency signal waveguide. Thereby, data transmission between the first module and the second module via the high-frequency signal waveguide is possible. For example, in the high-frequency signal waveguide, a region in which electromagnetic coupling to the module having the communication function is possible is provided as the addition unit. When the second module is arranged in the region as an additional module (for the configuration change), data transmission can be performed between the additional module and the existing module (first module) having the communication function. For example, the high-frequency signal waveguide is arranged in the housing and the first module and the second module having a millimeter-wave transmission function are mounted to be in contact with the high-frequency signal waveguide, so that communication of millimeter waves transmitted through the high-frequency signal waveguide is established and high-speed data transmission can be performed with reduced multipath, transmission degradation, and unnecessary radiation. For example, the first module having the communication function is arranged to be in contact with the high-frequency signal waveguide in the housing and the second module having a millimeter-wave function as an additional function is mounted to be in contact with the high-frequency signal waveguide, when necessary, so that communication of millimeter waves transmitted through the high-frequency signal waveguide is established. Thereby, it can be performed without burdens, such as a design change, increase in a substrate area, or increase in cost, associated with a configuration change such as a functional extension.

The electronic device of this embodiment may include a plurality of high-frequency signal waveguides. A first module having the communication function is coupled to at least one of the plurality of high-frequency signal waveguides. At the time of a configuration change, such as function addition, the second module having the communication function is further added as a configuration change module to the addition unit to which the first module is added, and coupled to a high-frequency signal waveguide among the plurality of high-frequency signal waveguide. Thereby, data transmission between the first module (mounted module) and the first module (configuration change module) via the high-frequency signal waveguide, independent of other high-frequency signal waveguides, is possible.

Alternatively, the electronic device of this embodiment may include a plurality of high-frequency signal waveguides, and a connection high-frequency signal waveguide which connects a plurality of high-frequency signal waveguides. The first module having the communication function is coupled to each of the plurality of high-frequency signal waveguides. At the time of the configuration change, such as the function addition, the second module having the communication function is further added as the configuration change module to an addition unit of at least one of the plurality of high-frequency signal waveguides, and is coupled to the high-frequency signal waveguide. Thereby, data transmission between the first module (mounted module) coupled to each of the plurality of high-frequency signal waveguides and the second module (configuration change module) via the high-frequency signal waveguide and the connection high-frequency signal waveguide is possible.

Further, preferably, the connection high-frequency signal waveguide may be attachable to and detachable from the plurality of high-frequency wave signal waveguides. When the connection high-frequency signal waveguide is removed from the plurality of high-frequency signal waveguides, it is possible to transmit data between the first module (mounted module) and the second module (configuration change module) via the high-frequency signal waveguide independently of another high-frequency signal waveguide.

In the electronic device of this embodiment, the high-frequency signal waveguide may be arranged along the housing. For example, upon insertion into a slot structure of an electronic device of a main body side having the slot structure, data transmission to and from the electronic device of the main body side is possible. Alternatively, when the high-frequency signal waveguide is installed in the arranged signal transmission device (for example, a cradle device), it is possible to transmit data via the high-frequency signal waveguide of the signal transmission device.

For example, in the electronic device of the main body side, the slot structure into which another electronic device can be inserted is provided as an example of an addition unit. The high-frequency signal waveguide is arranged parallel to a wall surface of the slot structure. Another electronic device is inserted into the slot structure, so that it is possible to transmit data to and from the other electronic device via the high-frequency signal waveguide. When the high-frequency signal waveguide is exposed from the housing, high-frequency signal waveguides can be in contact with each other.

Alternatively, in the electronic device that forms the signal transmission device (for example, the cradle device), a high-frequency signal waveguide is provided to be coupled to a high-frequency signal emitted from another electronic device having a communication function (for example, along a mounting surface). When the other electronic device is arranged in the vicinity of the high-frequency signal waveguide, the other electronic device can transmit data via the high-frequency signal waveguide. The other electronic device may be arranged in the vicinity of the mounting surface or installed on the mounting surface. When the high-frequency signal waveguide is exposed from the housing, the high-frequency signal waveguides can be in contact with each other.

For example, when a plurality of other electronic devices are arranged in the vicinity of the high-frequency signal waveguide of the signal transmission device, data transmission among the plurality of other electronic devices is possible. For example, it is possible to establish communication between a first module and a second module by arranging a first electronic device including a high-frequency signal waveguide and the first module arranged thereon, and a second electronic device including a high-frequency signal waveguide and the second module arranged thereon, on a cradle device having a surface on which a high-frequency signal waveguide is arranged. It is possible to deal with one electronic device as an external device of another electronic device by performing data transmission between different electronic devices, and to use the external device as a function extension of the other electronic device.

Alternatively, in the electronic device constituting the signal transmission device (for example, the cradle device), the first module having the communication function is coupled to the high-frequency signal waveguide. When another electronic device is arranged in the vicinity of the high-frequency signal waveguide of the signal transmission device, data transmission between the first module (mounted module) and the other electronic device is possible. It is possible to deal with the signal transmission device (for example, the cradle device) as the external device of the electronic device, and to use the signal transmission device as the function extension of the electronic device. On the other hand, it is possible to deal with the electronic device arranged in the vicinity of the high-frequency signal waveguide of the signal transmission device (for example, the cradle device) as the external device of the signal transmission device and to use the electronic device as the function extension of the signal transmission device. Alternatively, a communication circuit is provided so that a high-frequency signal is coupled to the high-frequency signal waveguide. The communication circuit includes a high-frequency coupler that takes electromagnetic coupling in an end surface of the high-frequency signal waveguide. The communication circuit is connectable to the external device. When the electronic device is arranged in the vicinity of the high-frequency signal waveguide, data transmission between the electronic device and the external device via the communication circuit is possible.

In the electronic device of this embodiment, at least part of the high-frequency signal waveguide may be exposed from the housing. For example, upon insertion into a slot structure of an electronic device of a main body side having the slot structure, it is possible to transmit data by contact with the high-frequency signal waveguide of the electronic device of the main body side. Alternatively, in the electronic device constituting the signal transmission device (for example, the cradle device), at least part of the high-frequency signal waveguide is exposed. Also, in another electronic device coupled to the high-frequency signal waveguide of the signal transmission device (for example, the cradle device), the high-frequency signal waveguide, which transmits a high-frequency signal, is exposed from the housing. When the other electronic device is caused to be in the vicinity of the high-frequency signal waveguide of the signal transmission device (for example, the cradle device), the high-frequency signal waveguides of the two are in contact with each other, so that data transmission is possible.

In the electronic device of this embodiment, upon including a slot structure into which another electronic device can be inserted as an example of an addition unit, the high-frequency signal waveguide has a flexible end and projects into the slot structure. For example, it is only necessary to attach a contact high-frequency signal waveguide formed of a flexible material to the high-frequency signal waveguide, and a tip end of the contact high-frequency signal waveguide projects into a slot structure. Another electronic device is inserted into the slot structure and comes in contact with the end of the high-frequency signal waveguide, so that data transmission to and from the other electronic device is possible. Preferably, in the electronic device inserted into the slot structure, at least part of the high-frequency signal waveguide may be exposed from the housing. Upon insertion into a slot structure of an electronic device of a main body side having the slot structure, the high-frequency signal waveguide of the electronic device of the main body side and the end of the high-frequency signal waveguide are in contact with each other and hence data transmission is possible. The end of the high-frequency signal waveguide is formed of a flexible material, so that a flexible function can be added without specifying a shape of an electronic device (in other words, an additional module) inserted into the slot structure or a position of a transfer structure of a high-frequency signal.

The electronic device may further increase transmission power compared to a contact case, because coupling to another high-frequency signal waveguide is performed in a non-contact form when the high-frequency signal waveguide is not exposed from the housing, regardless of a form in which a slot structure is included and a type of cradle device. Even when a distance between a high-frequency signal waveguide and another high-frequency signal waveguide coupled thereto is large and the waveguides are not directly coupled to each other, long-distance communication is also possible if an antenna structure is adopted as a transfer structure having a function of transferring the high-frequency signal. When the high-frequency signal waveguide is exposed from the housing, the high-frequency signal waveguide may be coupled with longitudinal electromagnetic waves.

Preferably, the electronic device of this embodiment may include a control unit which changes configuration information based on a module coupled to the high-frequency signal waveguide and controls data transmission according to the changed configuration information. Alternatively, a connection to a control unit arranged outside the device to change configuration information based on a module coupled to the high-frequency signal waveguide, and to control data transmission according to the changed configuration information may be possible.

The control unit, for example, manages configuration information before and after a new module is coupled to the high-frequency signal waveguide and controls data transmission according to changed configuration information. For example, before a certain module is arranged in the vicinity of the high-frequency signal waveguide, configuration information indicating that a first function is implemented is provided by performing data transmission between existing modules. When the new module is coupled to the high-frequency signal waveguide in this state, it is also possible to perform data transmission to and from the new module. Using the data transmission, a change to configuration information indicating that the new function can be implemented is made. Accordingly, by controlling the data transmission according to the changed configuration information, a new function can be implemented using the newly coupled module. Thereby, the overall function is changeable based on a module arranged in the vicinity of the high-frequency signal waveguide.

The control unit may sense an arrangement position in the high-frequency signal waveguide. Alternatively, the control unit may sense whether a module having a communication device is arranged on the high-frequency signal waveguide. For example, when another high-frequency signal waveguide coupled to a high-frequency signal waveguide is closely arranged, this is recognized. Preferably, an arrangement position or what has been arranged is also recognized Preferably, it may also be recognized whether a foreign object has been arranged. Alternatively, a power saving mode for a normal time may be set and it returns from the power saving mode when a communication process is necessary (that is, when another high-frequency signal waveguide coupled to the high-frequency signal waveguide is closely arranged).

Further, the high-frequency signal waveguide may have an overall linear shape (one-dimensional shape) or a two-dimensional shape. In the case of the two-dimensional shape, the high-frequency signal waveguide may have any transmission path form such as one in which a waveguide is formed by one plate, one in which a waveguide is arranged in a comb shape, one in which a waveguide is arranged in a lattice shape, or one in which a waveguide is arranged in a spiral shape, as long as the waveguide has the overall two-dimensional shape. Alternatively, the high-frequency signal waveguide may have an overall three-dimensional shape. In the case of the three-dimensional shape, a plurality of high-frequency signal waveguides of a two-dimensional shape may be established in parallel and arranged three-dimensionally. Because the width of the waveguide can also be adjusted if the waveguide is arranged in the comb shape or the spiral shape Compared to the case of the configuration of one plate, a structure having good coupling or minor loss is created. Although there is a possibility of interference with a signal through a different path or a negative effect because a plurality of paths are possible when the arrangement is made in the lattice shape, it is possible to recognize where what has been arranged from a time difference from delay waves. Because there is no part that bends at a right angle when the arrangement is made in the spiral shape, compared to the comb shape or the lattice shape, loss is minor and an effect of multipath is minor because there is one transmission path.

Alternatively, the high-frequency signal waveguide may be buried in a member different from a member constituting the high-frequency signal waveguide, even in the one-dimensional shape, the two-dimensional shape, and the three-dimensional shape. Alternatively, a layer constituted of a member different from a member constituting the high-frequency signal waveguide may be laminated on at least one of an upper layer and a lower layer of a layer on which the high-frequency signal waveguide is provided. The high-frequency signal waveguide may be fixed by a metal material.

A member constituting the high-frequency signal waveguide may be either a dielectric or a magnetic material, and may be flexible. There is an advantage in that simple plastic can be used as the dielectric material.

Preferably, wireless power feeding for a module may be performed as a radio-wave reception type, an electromagnetic induction type, or a resonance type. At this time, a power transmission signal may be transmitted via a high-frequency signal waveguide depending upon a frequency band.

[Signal Transmission Device and Signal Transmission Method]

A communication device for performing data transmission is as follows. In this embodiment, there are provided a transmission device that transmits a transmission target signal for a high-frequency signal of a radio-wave frequency band and a reception device that receives the transmission target signal transmitted from the transmission device. Frequency division multiplexing (FDM) or time division multiplexing (TDM) may be applied. The high-frequency signal is transmitted between the transmission device and the reception device via the high-frequency signal waveguide. In detail, when the transmission device and the reception device are arranged at predetermined positions, a high-frequency signal waveguide, which couples a high-frequency signal, is set to be arranged between the transmission device and the reception device. Thereby, it is possible to transmit the high-frequency signal via the high-frequency signal waveguide because the transmission target signal is converted into a high-frequency signal between the transmission device and the reception device. A signal transmission device for the transmission target signal includes a transmission device (transmission-side communication device) that transmits a transmission target signal as a high-frequency signal and a reception device (reception-side communication device) that receives the high-frequency signal transmitted from the transmission device and reproduces the transmission target signal.

The transmission device or the reception device is provided in an electronic device. If both the transmission device and the reception device are provided in each electronic device, it is possible to deal with two-way communication. By mounting electronic devices at predetermined positions, it is possible to perform signal transmission between the two.

The signal transmission device may have an aspect in which only a high-speed or large-volume signal among various transmission target signals is set as a target of conversion into a high-frequency signal of a radio-wave frequency band, and others that are enough for a low speed and a small volume, or a signal regarded to be a direct current, such as a power source, are not set as the conversion target. Further, others that are enough for a low speed and a small volume may also be included in the target of conversion into a high-frequency signal of a radio-wave frequency band. Also, a power source may be transmitted via the high-frequency signal waveguide according to a power supply device and a power reception device. That is, in addition to a high-speed or large-volume signal, others that are enough for a low speed or a small volume may be converted into high-frequency signals and transmitted. Further, it is only necessary to transmit all signals including a power source (power) via the high-frequency signal waveguide by applying wireless power feeding. A signal, which is not a target of transmission in a frequency signal of a radio-wave frequency band, is transmitted through electrical wiring as done previously. Electrical signals of an original transmission target before conversion into a frequency signal of a radio-wave frequency band are collectively referred to as a baseband signal.

Incidentally, it is only necessary to perform power transmission and signal transmission of different signals when wireless power feeding is performed, and a frequency of a power transmission signal may be different from or the same as a frequency of a carrier signal for signal transmission in the limit. From the point of view of preventing an influence of noise or the like due to a power transmission signal, preferably, the frequency of the power transmission signal is different from the frequency of the carrier signal for the signal transmission. It is only necessary for the frequency of the power transmission signal not to overlap a frequency band to be used in wireless communication of information, and various frequencies may be used within this limit. Also, although an applicable modulation scheme is limited, carriers of the signal transmission and the power transmission may be common when degradation of power transmission efficiency is allowed (in this case, the frequency of the power transmission signal is the same as the frequency of a carrier signal for the signal transmission).

If the frequency signal of a radio-wave frequency band is used for signal transmission, there is no problem when electrical wiring or light is used. That is, if the frequency signal of the radio-wave frequency band is used in signal transmission regardless of electrical wiring or light, it is possible to apply wireless communication technology, eliminate difficulty than when electrical wiring is used, and construct a signal interface in a simpler and cheaper configuration than when light is used. From the point of view of a size and cost, it is more advantageous than when light is used. Preferably, in this embodiment, it is preferred to mainly use a carrier frequency of a millimeter-wave band (a wavelength is 1 to 10 millimeters) for signal transmission. However, the present disclosure is not limited to the millimeter-wave band, and is applicable even when a carrier frequency close to the millimeter-wave band, for example, such as a sub-millimeter-wave band having a shorter wavelength (a wavelength is 0.1 to 1 millimeters) or a long centimeter-wave band having a longer wavelength (a wavelength is 1 to 10 centimeters), is used. For example, a range from the sub-millimeter-wave band to the millimeter-wave band, a range from the millimeter-wave band to the centimeter-wave band, or a range from the sub-millimeter-wave band to the millimeter-wave band and the centimeter-wave band may be used. If the millimeter-wave band or its vicinity is used for signal transmission, the necessity of electromagnetic compatibility (EMC) suppression is low, as when electrical wiring (for example, flexible printed wiring) is used for signal transmission without interfering with other electrical wiring. If the millimeter-wave band or its vicinity is used for signal transmission, a data rate is increased more than when electrical wiring (for example, flexible printed wiring) is used, and therefore it is also possible to easily cope with high-speed/high-data-rate transmission such as speed increase of an image signal due to high definition or a high frame rate.

[Embodiment 1]

[Overall Configuration]

FIG. 1 is a diagram illustrating an outline of the overall configuration of an electronic device of the embodiment 1 in which the signal transmission device of this embodiment is installed.

The embodiment 1 is a form in which another signal processing module (referred to as a configuration change signal processing module) is added when a function change is made in the case in which there are one or more signal processing modules (which may be signal processing circuits, semiconductor integrated circuits (ICs), or the like) within an electronic device 300A (an electronic device 300A_1 or 300A_2). In particular, a difference from other embodiments described later is a form in which each signal processing module is electromagnetically coupled to a high-frequency signal waveguide 308 (high-frequency signal transmission path) having a function of relaying (coupling) transmission of a high-frequency signal between the signal processing modules. "Electromagnetic coupling" is "electromagnetically connecting (coupling)" and means that a high-frequency signal is connected to be transmitted within each connected high-frequency signal waveguide. Incidentally, a high-frequency signal waveguide 308A is not limited to a linear or planar high-frequency signal waveguide 308A_1 as illustrated in FIG. 1(A), and may be a bent high-frequency signal waveguide 308A_2 as illustrated in FIG. 1(B). For example, it is only necessary for the high-frequency signal waveguide 308A_2 to be formed of a flexible material.

The electronic device 300A includes a central control unit 302, which controls the overall operation of the device, and the high-frequency signal waveguide 308A. The high-frequency signal waveguide 308A is arranged along (substantially parallel to) a wall surface of a housing of the electronic device 300A. Here, the electronic device 300A is provided with one or more signal processing modules mounted on the high-frequency signal waveguide 308A. Preferably, the signal processing module is mounted in contact with the high-frequency signal waveguide 308. The mounted signal processing module is referred to as an existing signal processing module 304. The existing signal processing module 304 may be responsible for a function of the central control unit 302. At this time, a plurality of existing signal processing modules 304 as well as any one existing signal processing module 304 may be responsible therefor. The existing signal processing module 304 may be arranged on any surface of the high-frequency signal waveguide 308. Each existing signal processing module 304 performs predetermined signal processing by itself and performs signal processing while data is exchanged between the existing signal processing modules 304 when a plurality of existing signal processing modules 304 are mounted.

The central control unit 302 changes configuration information based on a signal processing module coupled to the high-frequency signal waveguide 308, and controls data transmission according to the changed configuration information. For example, if it is recognized that a combination configuration of signal processing modules having a sincerity function has been changed, data transmission is controlled to be performed between signal processing modules suitable for a changed module combination or central processing units (CPUs) (which may be central control units 302). It is only necessary to use normal electrical wiring (a printed pattern, wire hardness, or the like) for a signal for control or module recognition. For example, the central control unit 302 includes an arrangement sensing unit, which senses that the configuration change signal processing module 306 is mounted on the high-frequency signal waveguide 308, and a communication control unit which controls the existing signal processing module 304 or the configuration change signal processing module 306 and controls communication between signal processing modules according to a configuration change when the arrangement sensing unit has sensed that the configuration change signal processing module 306 has been mounted. The arrangement sensing unit may include a recognition function of recognizing an arrangement position or what has been arranged as well as a function of sensing whether the signal processing module 306 has been installed in the high-frequency signal waveguide 308. In relation to the function of recognizing "what has been arranged" or the like, a technique similar to that of the central control unit 402 described later may be adopted.

When signal processing is performed between existing signal processing modules 304, a communication process is performed via the high-frequency signal waveguide 308 by performing conversion into a high-frequency signal of a millimeter-wave band or a frequency band before or after the millimeter-wave band (for example, a sub-millimeter-wave band or a centimeter-wave band) (hereinafter representatively referred to as a millimeter-wave band) in terms of high-speed or large-volume data. It is only necessary to transmit other data (including a power source) through normal electrical wiring (including pattern wiring). A communication device, which implements a millimeter-wave transmission function, is provided in the existing signal processing module 304 so as to perform a communication process in a millimeter-wave band via the high-frequency signal waveguide 308 between existing signal processing modules 304 (described later with reference to FIG. 2), and a high-frequency signal coupling structure provided in the communication device and the high-frequency signal waveguide 308A are arranged to be able to be electromagnetically coupled. For example, each existing signal processing module 304 is mounted to be in contact with the high-frequency signal waveguide 308A, so that communication of millimeter waves transmitted through the high-frequency signal waveguide 308A is established. Further, using so-called FDM with a plurality of carrier frequencies which are different frequencies, communication of a plurality of systems in one frequency signal transmission path 308 is possible.

Here, there is provided a region in which the configuration change signal processing module 306 (in other words, a communication device) in which a communication process in a millimeter-wave band is possible when a function change is made can be mounted (that is, a region capable of being electromagnetically coupled to an additional module: hereinafter referred to as an additional module mounting region) in the high-frequency signal waveguide 308A. In the illustrated example, the additional module mounting region 309 is provided outside a region in which the existing signal processing module 304 is mounted. When the configuration change signal processing module 306 is added later, the configuration change signal processing module 306 is installed in the additional module mounting region 309, in a state in which there is an existing signal processing module 304 installed in advance on the high-frequency signal waveguide 308, so that high-speed/large-volume millimeter-wave communication is established via the high-frequency signal waveguide 308A. Thereby, high-speed data transmission using millimeter waves is performed with low loss.

In the housing of the electronic device 300A, the high-frequency signal waveguide 308 is arranged, and the existing signal processing module 304 having a millimeter-wave transmission function and the configuration change signal processing module 306 are mounted facing the high-frequency signal waveguide 308 (preferably, to be in contact therewith: in detail, so that the high-frequency signal can be electromagnetically coupled). Thereby, communication of millimeter waves transmitted through the high-frequency signal waveguide 308 between the existing signal processing module 304 and the configuration change signal processing module 306 is established and high-speed data transmission can be performed with reduced multipath, transmission degradation, and unnecessary radiation. When the existing signal processing module 304 having the millimeter-wave transmission function is arranged on the high-frequency signal waveguide 308 so that a high-frequency signal can be electromagnetically coupled, and a configuration change such as a function change is necessary even if a plurality of signal processing modules for millimeter wave communication are not initially installed, communication of millimeter waves transmitted through the high-frequency signal waveguide 308 can be established by arranging the configuration change signal processing module 306 in the additional module mounting region 309 on the high-frequency signal waveguide 308 so that the high-frequency signal can be electromagnetically coupled. Incidentally, the dashed line in the drawing represents a transmission system of a high-frequency signal at the time of a configuration change (this is also similar in other embodiments described later). Thus, intra-device communication can be easily implemented regardless of burdens, such as a design change, increase in a substrate area, or increase in cost, associated with a configuration change such as a function extension.

[Communication Processing System]

Figure 2:
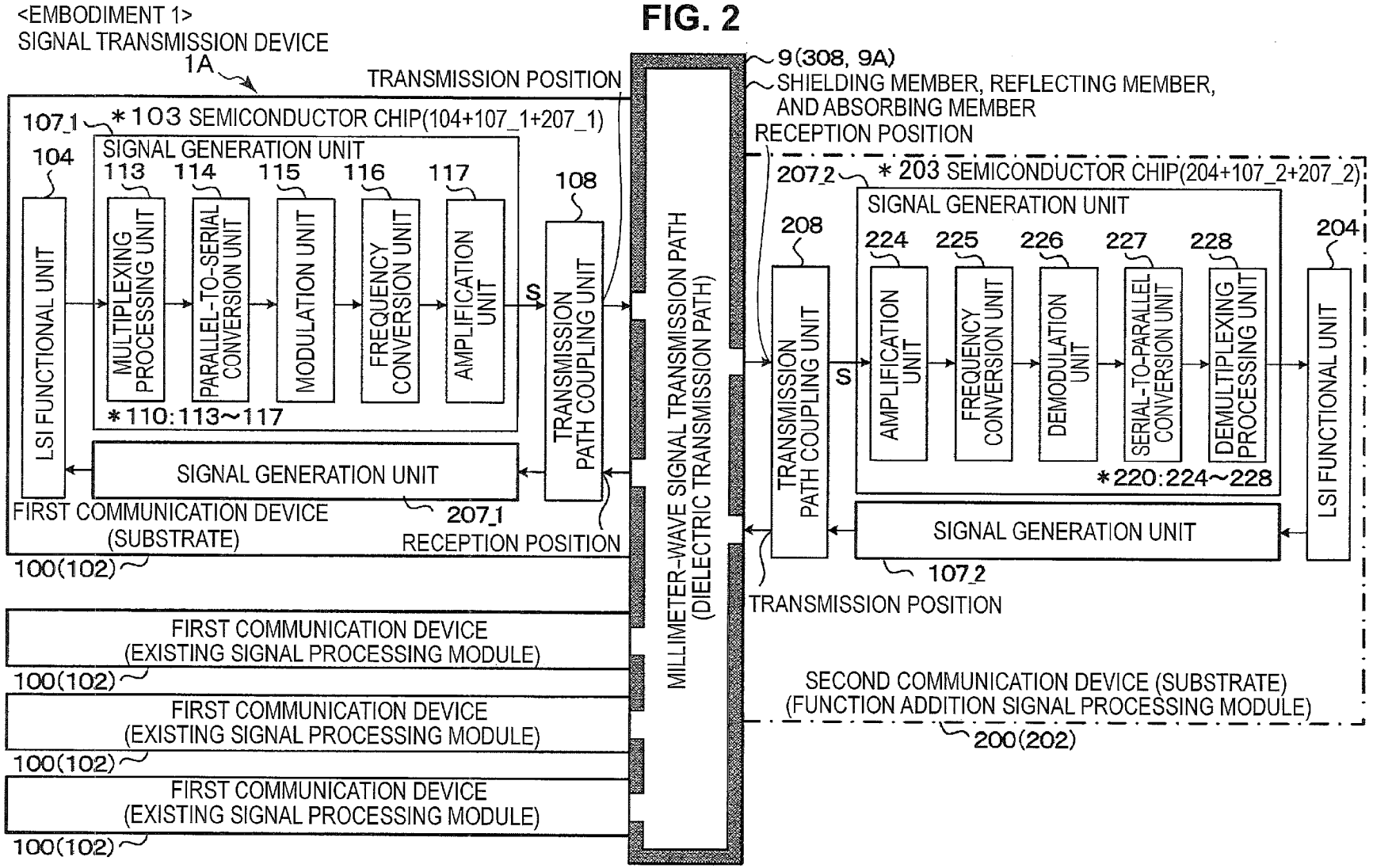
FIG. 2 is a diagram illustrating a signal interface of the signal transmission device of the embodiment 1 installed in the electronic device of the embodiment 1 from the point of view of a functional configuration.

FIG. 2 is a diagram illustrating a signal interface of a signal transmission device 1A of the embodiment 1 installed in the electronic device 300A of the embodiment 1 from the point of view of a functional configuration. In other words, FIG. 2 is a functional block diagram focused on a communication process in the electronic device 300A, The signal transmission device 1A is configured so that a first communication device 100, which is an example of a first wireless device, and a second communication device 200, which is an example of a second wireless device, are coupled via the millimeter-wave signal transmission path 9 (an example of the high-frequency signal waveguide 308) and perform signal transmission in a millimeter-wave band. A semiconductor chip 103 corresponding to transmission/reception in the millimeter-wave band is provided in the first communication device 100, and a semiconductor chip 203 corresponding to transmission/reception in the millimeter-wave band is provided in the second communication device 200.

The first communication device 100 corresponds to the communication device provided in the existing signal processing module 304, and a plurality of first communication devices 100 are provided in the illustrated example, and high-speed/large-volume data transmission in the millimeter-wave band between the first communication devices 100 is possible in a state in which no second communication device 200 is installed. When the second communication device 200 corresponds to a communication device provided in the configuration change signal processing module 306 and is installed on the millimeter-wave signal transmission path 9, the high-frequency signal (an electrical signal of the millimeter-wave band) can be electromagnetically coupled and high-speed/large-volume data transmission to and from the existing signal processing module 304 is possible in the millimeter-wave band.

In this embodiment, a signal serving as a target of communication in the millimeter-wave band is set only as a high-speed or large-volume signal, and others that are enough for a low speed/small volume or a signal regarded to be a direct current such as a power source are not set as a target of conversion into a millimeter-wave signal. For a signal (including a power source) that is not a target of conversion into a millimeter-wave signal, a signal connection is made using a technique as done previously. Electrical signals of an original transmission target before conversion into millimeter waves are collectively referred to as a baseband signal. Each signal generation unit, described later, is an example of a millimeter-wave signal generation unit or an electrical signal conversion unit.

In the first communication device 100, a semiconductor chip 103 and a transmission path coupling unit 108 corresponding to transmission/reception in the millimeter-wave band are installed on a substrate 102. The semiconductor chip 103 is a large scale integrated circuit (LSIC) into which a large scale integration (LSI) functional unit 104, which is an example of a front-stage signal processing unit, is integrated with a signal generation unit 107_1 for transmission processing, and a signal generation unit 207_1 for reception processing. Although not illustrated, the LSI functional unit 104, the signal generation unit 107_1, and the signal generation unit 207_1 may be separately configured, or any two may be configured to be integrated.

The semiconductor chip 103 is connected to the transmission path coupling unit 108. Incidentally, although it will be described later, the transmission path coupling unit 108 can be configured to be embedded in the semiconductor chip 103. A portion in which the transmission path coupling unit 108 and the millimeter-wave signal transmission path 9 are coupled together (that is, a portion that transmits a wireless signal) is a transmission position or a reception position, and an antenna typically corresponds thereto.

The LSI functional unit 104 manages primary application control of the first communication device 100, and, for example, includes a circuit for processing various signals to be transmitted to a counterpart, or a circuit for processing various signals received from a counterpart (the second communication device 200).

In the second communication device 200, the semiconductor chip 203 and a transmission path coupling unit 208 corresponding to transmission/reception in the millimeter-wave band are mounted on a substrate 202. The semiconductor chip 203 is connected to the transmission path coupling unit 208. Incidentally, although it will be described later, the transmission path coupling unit 208 can be configured to be embedded in the semiconductor chip 203. As the transmission path coupling unit 208, one similar to the transmission path coupling unit 108 is adopted. The semiconductor chip 203 is an LSI into which an LSI functional unit 204, which is an example of a rear-stage signal processing unit, is integrated with a signal generation unit 207_2 for reception processing and a signal generation unit 107_2 for reception processing. Although not illustrated, the LSI functional unit 204, the signal generation unit 107_2, and the signal generation unit 207_2 may be separately configured, or any two may be configured to be integrated.

The transmission path coupling units 108 and 208 electromagnetically couple a high-frequency signal (an electrical signal of the millimeter-wave band) to the millimeter-wave signal transmission path 9. For example, an antenna structure including an antenna coupling unit, an antenna terminal, an antenna, and the like is applied. Alternatively, the antenna structure may be a transmission line itself, such as a microstrip line, a strip line, a coplanar line, or a slot line.

The signal generation unit 107_1 has a transmission-side signal generation unit 110 for converting a signal from the LSI functional unit 104 into a millimeter-wave signal and performing signal transmission control via the millimeter-wave signal transmission path 9. The signal generation unit 207_1 has a reception-side signal generation unit 220 for performing signal reception control via the millimeter-wave signal transmission path 9. The signal generation unit 207_2 has the transmission-side signal generation unit 110 for converting a signal from the LSI functional unit 204 into a millimeter-wave signal and performing signal transmission control via the millimeter-wave signal transmission path 9. The signal generation unit 207_2 has the reception-side signal generation unit 220 for performing signal reception control via the millimeter-wave signal transmission path 9. The transmission-side signal generation unit 110 and the transmission path coupling unit 108 constitute a transmission system (a transmission unit: a transmission-side communication unit). The reception-side signal generation unit 220 and the transmission path coupling unit 208 constitute a reception system (a reception unit: a reception-side communication unit).

In order to generate a millimeter-wave signal by performing signal processing on the input signal, the transmission-side signal generation unit 110 includes a multiplexing processing unit 113, a parallel-to-serial conversion unit 114, a modulation unit 115, a frequency conversion unit 116, and an amplification unit 117. The amplification unit 117 is an example of an amplitude adjustment unit that adjusts the magnitude of the input signal and outputs the input signal whose magnitude is adjusted. The modulation unit 115 and the frequency conversion unit 116 may be integrated as a so-called direct conversion type.

When there are a plurality of (N1) types of signals serving as a communication target in the millimeter-wave band within a signal from the LSI functional unit 104, the multiplexing processing unit 113 performs a multiplexing process such as TDM, FDM, or code division multiplexing to integrate the plurality of types of signals into a single-system signal. For example, the multiplexing processing unit 113 integrates a plurality of types of high-speed or large-volume signals as the target to be transmitted through millimeter waves into a single-system signal.

The parallel-to-serial conversion unit 114 converts parallel signals into a serial data signal, and supplies the serial signal to the modulation unit 115. The modulation unit 115 modulates a transmission target signal, and supplies the modulated signal to the frequency conversion unit 116. The parallel-to-serial conversion unit 114 is provided in the case of a parallel interface spec in which a plurality of signals for parallel transmission are used when this embodiment is not applied, and is unnecessary in the case of a serial interface spec.

It is only necessary for the modulation unit 115 to basically modulate at least one of the amplitude, frequency, or phase in a transmission target signal, and an arbitrary combination scheme thereof can also be adopted. Examples of an analog modulation scheme are amplitude modulation (AM) and vector modulation. Examples of vector modulation include frequency modulation (FM) and phase modulation (PM). Examples of a digital modulation scheme are amplitude shift keying (ASK), frequency shift keying (FSK), phase shift keying (PSK), and amplitude phase shift keying (APSK) in which the amplitude and phase are modulated. Quadrature Amplitude Modulation (QAM) is a representative example of amplitude/phase modulation. In this embodiment, in particular, a scheme is adopted in which a synchronous detection scheme can be adopted on the reception side.

The frequency conversion unit 116 generates a millimeter-wave electrical signal (a high-frequency signal) by converting the frequency of the transmission target signal modulated by the modulation unit 115, and supplies the millimeter-wave electrical signal to the amplification unit 117. The "millimeter-wave electrical signal" refers to an electrical signal of a certain frequency in a range of about 30 GHz to 300 GHz. It is only necessary for a frequency value described using the term "about" to be accurate to the extent that the effect of millimeter-wave communication is obtained, and the frequency is based on the fact that the lower limit is not limited to 30 GHz, and the upper limit is not limited to 300 GHz.

Although various circuit configurations can be adopted as the frequency conversion unit 116, for example, it is only necessary to adopt a configuration having a frequency mixing circuit (a mixer circuit) and a local oscillation circuit. The local oscillation circuit generates a carrier (a carrier signal or a reference carrier) for use in modulation. The frequency mixing circuit generates a transmission signal of a millimeter-wave band by multiplying (modulating) the carrier of a millimeter-wave band generated by the local oscillator circuit with a signal from the parallel-to-serial conversion unit 114, and supplies the transmission signal to the amplification unit 117.

The amplification unit 117 amplifies the millimeter-wave electrical signal after the frequency conversion, and supplies the amplified signal to the transmission path coupling unit 108. The amplification unit 117 is connected to the two-way transmission path coupling unit 108 via an antenna terminal (not illustrated). The transmission path coupling unit 108 transmits the millimeter-wave signal generated by the signal generation unit 110 on the transmission side to the millimeter-wave signal transmission path 9. The transmission path coupling unit 108, for example, includes an antenna coupling unit. The antenna coupling unit constitutes an example of the transmission path coupling unit 108 (signal coupling unit) or part thereof. The antenna coupling unit refers to a portion that couples an electronic circuit within a semiconductor chip to an antenna arranged inside or outside the chip in a narrow sense, and refers to a portion that performs signal coupling between the semiconductor chip and the millimeter-wave signal transmission path 9 in a broad sense. For example, the antenna coupling unit includes at least an antenna structure. The antenna structure refers to a structure in a unit electromagnetically coupled (by an electromagnetic field) to the millimeter-wave signal transmission path 9. It is only necessary for the antenna structure to couple an electrical signal of a millimeter-wave band to the millimeter-wave signal transmission path 9, and the antenna structure does not refer to only an antenna itself.

In order to generate an output signal by performing signal processing on the millimeter-wave electrical signal received by the transmission path coupling unit 208, the reception-side signal generation unit 220 includes an amplification unit 224, a frequency conversion unit 225, a demodulation unit 226, a serial-to-parallel conversion unit 227, and a demultiplexing processing unit 228. The amplification unit 224 is an example of an amplitude adjustment unit that adjusts the magnitude of the input signal and outputs the input signal whose magnitude is adjusted. The frequency conversion unit 225 and the demodulation unit 226 may be integrated as a so-called direct conversion type. Also, a demodulated carrier signal may be generated by applying an injection lock method. The reception-side signal generation unit 220 is connected to the transmission path coupling unit 208. The reception-side amplification unit 224 is connected to the transmission path coupling unit 208 and amplifies a millimeter-wave electrical signal received by the antenna, and then supplies the amplified signal to the frequency conversion unit 225. The frequency conversion unit 225 converts the frequency of the amplified millimeter-wave electrical signal, and supplies the frequency-converted signal to the demodulation unit 226. The demodulation unit 226 demodulates the frequency-converted signal to acquire a baseband signal, and supplies the baseband signal to the serial-to-parallel conversion unit 227.

The serial-to-parallel conversion unit 227 converts the serial received data into parallel output data, and supplies the parallel output data to the demultiplexing processing unit 228. Like the parallel-to-serial conversion unit 114, the serial-to-parallel conversion unit 227 is provided in the case of a parallel interface spec in which a plurality of signals for parallel transmission are used when this embodiment is not applied. When the original signal transmission between the first communication device 100 and the second communication device 200 is in a serial form, the parallel-to-serial conversion unit 114 and the serial-to-parallel conversion unit 227 may not be provided.

When the original signal transmission between the first communication device 100 and the second communication device 200 is in a parallel form, the number of signals to be converted into millimeter waves is reduced by performing parallel-to-serial conversion on the input signal and transmitting a serial signal to the semiconductor chip 203, or by performing serial-to-parallel conversion on a received signal from the semiconductor chip 203.

The demultiplexing processing unit 228 corresponds to the multiplexing processing unit 113 and separates signals integrated into one system into a plurality of types of signals_n (n denotes 1 to N). For example, a plurality of data signals integrated into a signal of one system are separated, and the separated data signals are supplied to the LSI functional unit 204.

The LSI functional unit 204 manages primary application control of the second communication device 200, and, for example, includes a circuit for processing various signals received from a counterpart.

[Dealing with One-Way Communication]

Although the example illustrated in FIG. 2 is a configuration corresponding to two-way communication, a configuration including only any one of a pair of the signal generation unit 107_1 and the signal generation unit 207_1, and a pair of the signal generation unit 107_2 and the signal generation unit 207_2, serves as a configuration corresponding to the one-way communication.

Incidentally, the "two-way communication" illustrated in FIG. 2 serves as single-core, two-way communication transmission in which the millimeter-wave signal transmission path 9 that is a millimeter-wave transmission path is a single system (a single core). In order to implement the above, a half-duplex scheme to which TDM (TDD: Time Division Duplex) is applied, FDM (FDD: Frequency Division Duplex), or the like, is applied.

[Millimeter-Wave Signal Transmission Path]

The millimeter-wave signal transmission path 9, which is a millimeter-wave propagation path, for example, may be configured to propagate through a space within a housing as a free space transmission path. In this embodiment, preferably, the millimeter-wave signal transmission path 9 includes a waveguide, a transmission line, a dielectric line, or a waveguide structure within a dielectric or the like, and serves as a high-frequency signal waveguide 308 having a property of efficiently transmitting electromagnetic waves by configuring electromagnetic waves of a millimeter-wave band to be confined within the transmission path. For example, the millimeter-wave signal transmission path 9 may be configured as a dielectric transmission path 9A configured to contain a dielectric material (a member formed by a dielectric) having a relative dielectric constant within a given range and a dielectric loss tangent within a given range. The dielectric transmission path 9A is configured by making a connection between the antenna of the transmission path coupling unit 108 and the antenna of the transmission path coupling unit 208 using a dielectric line which is a linear member having a line diameter formed of a dielectric material or an electric plate path which is a plate-like member having a certain thickness. For example, the dielectric transmission path 9A may be a circuit substrate itself or may be provided on the substrate or embedded in the substrate. Plastic can be used as a dielectric material, and the dielectric transmission path 9A can be cheaply configured. For the dielectric plate path, it is possible to adopt various forms such as a form created by one dielectric plate, a form in which a transmission path (a waveguide: this is substantially the same hereinafter) is arranged in a comb shape (for example, notches are formed in one dielectric plate), a form in which a transmission path is arranged in a lattice shape (for example, a plurality of openings are provided in one dielectric plate), and a form in which one transmission path is arranged in a spiral shape. Also, the transmission path may be embedded in another dielectric having a different dielectric constant or installed on another dielectric having a different dielectric constant. To avoid unintended movement, the transmission path to the housing or the like may be fixed using an adhesive, a metal, or another fixing material. Further, instead of the dielectric material, a magnetic material can be used.

The periphery (an upper surface, a lower surface, and a side surface: a portion corresponding to the transmission position or the reception position is excluded) of the dielectric transmission path 9A, excluding the region in which the existing signal processing module 304 is installed or the additional module mounting region 309 in which the configuration change signal processing module 306 is installed, may be preferably surrounded with a shielding material (preferably, a metal member including metal plating is used) so that there is no influence of unnecessary electromagnetic waves from outside or no millimeter waves leak out from inside. Because the metal member functions as a reflecting material when used as the shielding material, a reflected component is used, so that reflected waves can be used for transmission and reception and sensitivity is improved. However, there may be a problem in that unnecessary standing waves occur within the millimeter-wave signal transmission path 9 due to multi-reflection within the millimeter-wave signal transmission path 9. In order to avoid this problem, the periphery (an upper surface, a lower surface, and a side surface) of the dielectric transmission path 9A, excluding the region in which the existing signal processing module 304 or the configuration path signal processing module 306 is installed, may remain open, and an absorbing material (radio-wave absorbing body), which absorbs millimeter waves, may be arranged. Although it is difficult to use the reflected waves for transmission and reception when a radio-wave absorbing body is used, radio waves leaked from an end can be absorbed, so that leakage to outside can be prevented and a multi-reflection level within the millimeter-wave signal transmission path 9 can be decreased.

[Connection and Operation]

A technique of performing signal transmission by converting a frequency of an input signal is typically used for broadcasting or wireless communication. In such applications, a relatively complex transmitter, receiver, or the like, which can cope with the problems of how far communication can be performed (a problem of a signal-to-noise (S/N) ratio against thermal noise), how to cope with reflection and multipath, how to suppress disturbance or interference with other paths, and the like, are used.

On the other hand, because the signal generation units 107 and 207 used in this embodiment are used in a millimeter-wave band, which is a higher frequency band than that used in a complex transmitter, receiver, or the like, typically used for broadcasting or wireless communication, and the wavelength 2, is short, units capable of easily reusing a frequency and suitable for communication among a number of adjacently arranged devices are used as the signal generation units 107 and 207.

In this embodiment, it is possible to flexibly cope with a high speed and a large volume by performing signal transmission in a millimeter-wave band as described above, unlike a signal interface using electrical wiring of the related art. For example, only high-speed or large-volume signals serve as a target of communication in a millimeter-wave band. Depending on the device configuration, the first communication device 100 and the second communication device 200 partly include an interface using electrical wiring (a connection by a terminal/connector) as done previously for low-speed/small-volume signals and power supply.

The signal generation unit 107 is an example of a signal processing unit that performs predetermined signal processing based on a set value (parameter). In this example, the signal generation unit 107 performs signal processing on an input signal input from the LSI functional unit 104 to generate a millimeter-wave signal. The signal generation units 107 and 207, for example, are connected to the transmission path coupling unit 108 via a transmission line such as a micro-strip line, a strip line, a coplanar line, or a slot line, and the generated millimeter-wave signal is supplied to the millimeter-wave signal transmission path 9 via the transmission path coupling unit 108.

The transmission path coupling unit 108, for example, has an antenna structure, and has a function of converting the transmitted millimeter-wave signal into electromagnetic waves and transmitting the electromagnetic waves. The transmission path coupling unit 108 is electromagnetically coupled to the millimeter-wave signal transmission path 9, and the electromagnetic wave converted by the transmission path coupling unit 108 is supplied to one end of the millimeter-wave signal transmission path 9. The other end of the millimeter-wave signal transmission path 9 is coupled to the transmission path coupling unit 208 on the side of the second communication device 200. By providing the millimeter-wave signal transmission path 9 between the transmission path coupling unit 108 on the side of the first communication device 100 and the transmission path coupling unit 208 on the side of the second communication device 200, electromagnetic waves of a millimeter-wave band propagate through the millimeter-wave signal transmission path 9. The transmission path coupling unit 208 receives electromagnetic waves transmitted to the other end of the millimeter-wave signal transmission path 9, converts the electromagnetic waves into a millimeter-wave signal, and then supplies the millimeter-wave signal to the signal generation unit 207 (baseband signal generation unit). The signal generation unit 207 is an example of a signal processing unit that performs predetermined signal processing on the basis of a set value (parameter). In this example, the signal generation unit 207 performs signal processing on the converted millimeter-wave signal to generate an output signal (baseband signal), and supplies the generated output signal to the LSI functional unit 204. Although the case of signal transmission from the first communication device 100 to the second communication device 200 has been described above, it is possible to transmit a millimeter-wave signal in two ways if the case of signal transmission from the LSI functional unit 204 of the second communication device 200 to the first communication device 100 is similarly considered.

[Signal Processing Module]

Figure 3:
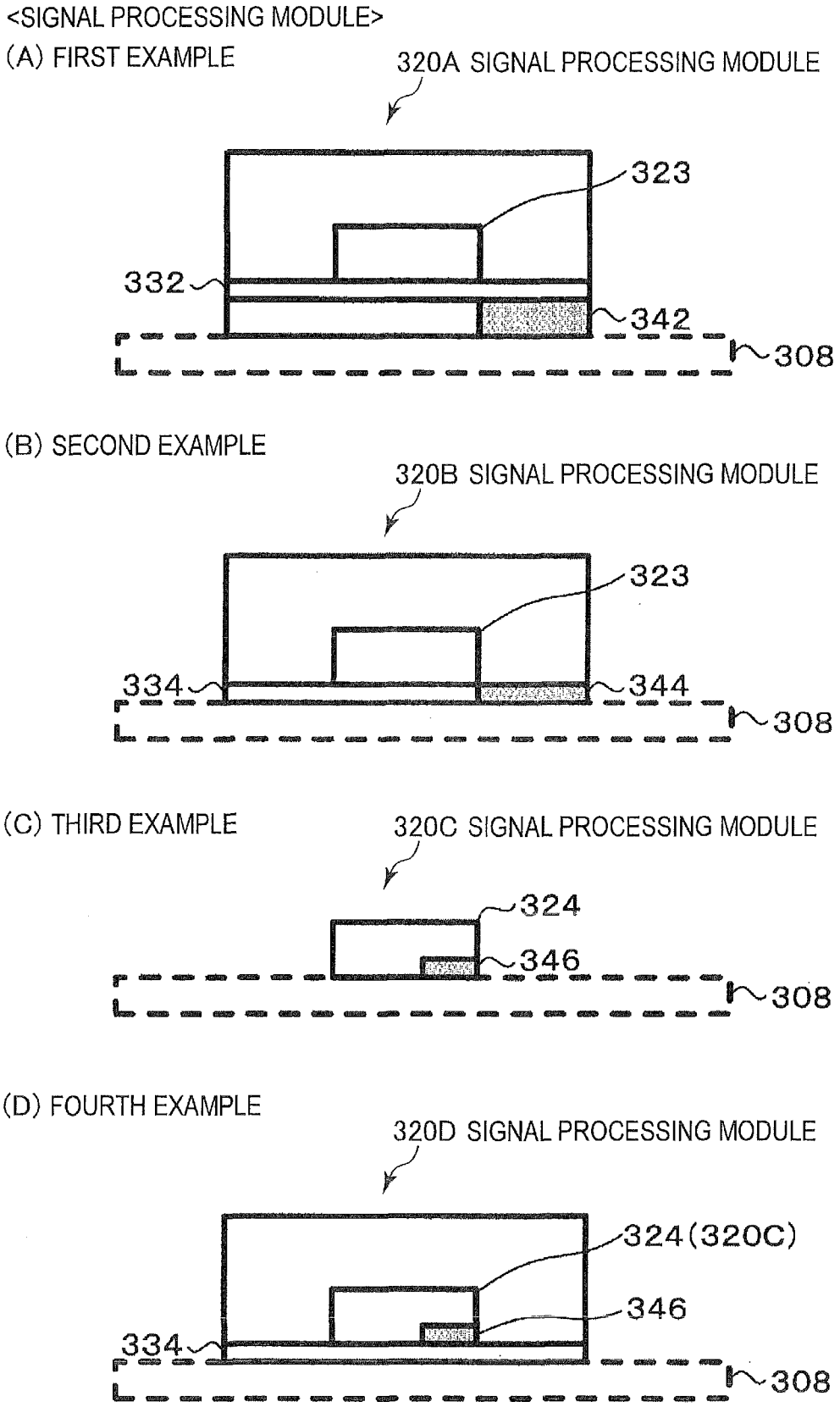
FIGS. 3(A) to 3(D) are diagrams illustrating an example configuration of a signal processing module having a communication function.

FIG. 3 is a diagram illustrating an example configuration of an existing signal processing module 304 having a communication function and a configuration change signal processing module 306 (hereinafter collectively referred to as a signal processing module 320). Further, although not illustrated, when necessary, an electrical connection by a connector (electrical wiring) as done previously is made for use of a signal (including the use for a power source) which is not a target of transmission in a high-frequency signal of a radio-wave frequency band.

In a signal processing module 320A of a first example illustrated in FIG. 3(A), a semiconductor chip 323 (corresponding to the semiconductor chip 103 or 203) having a primary function as the signal processing module 320A is arranged on the high-frequency signal waveguide 332. On the surface opposite the semiconductor chip 323 of the high-frequency signal waveguide 332, a high-frequency signal coupling structure 342 (corresponding to the transmission path coupling unit 108 or 208) having a transfer (coupling) function of a high-frequency signal (for example, millimeter waves) near the semiconductor chip 323 is provided. Preferably, the entire signal processing module 320A is not necessarily molded by a resin or the like. Incidentally, even in the case of molding, preferably, the side opposite the semiconductor chip 323 (an installation surface side for the high-frequency signal waveguide 308 indicated by the dashed line in the drawing) is flat to be easily arranged on the high-frequency signal waveguide 308 of the electronic device 300. More preferably, a portion of the high-frequency signal coupling structure 342 may be exposed so that the high-frequency signal coupling structure 342 comes in contact with the high-frequency signal waveguide 308.

It is only necessary for the high-frequency signal coupling structure 342 to be electromagnetically coupled to the high-frequency signal waveguide 308 of the electronic device 300. For example, although a transmission line such as a micro-strip line, a strip line, a coplanar line, or a slot line is adopted in addition to a dielectric material itself, the present disclosure is not limited thereto.

Incidentally, when the dielectric material itself is used as the high-frequency signal coupling structure 342, the same material as in the high-frequency signal waveguide 332 is preferred. In the case of a different material, a material having the same dielectric constant is preferred. Further, when the dielectric material itself is used as the high-frequency signal coupling structure 342, it is preferred that the high-frequency signal waveguide 308 also has the same material as the high-frequency signal waveguide 332 and the high-frequency signal coupling structure 342. In the case of a different material, a material having the same dielectric constant is preferred. Various factors such as material quality, width, and thickness of a dielectric material are determined according to a used frequency.

If the signal processing module 320A of this structure is installed so that the high-frequency signal waveguide 308 is arranged facing a lower part of the high-frequency signal coupling structure 342, it is possible to transmit a high-frequency signal from the semiconductor chip 323 to the high-frequency signal waveguide 308 via the high-frequency signal waveguide 332 and the high-frequency signal coupling structure 342. When the dielectric material itself is used without adopting a high-frequency transmission line such as a micro-strip line, or an antenna structure such as a patch antenna, as the high-frequency signal coupling structure 342, all of the high-frequency signal waveguide 308, the high-frequency signal waveguide 332, and the high-frequency signal coupling structure 342 can be connected by the dielectric material. It is possible to establish millimeter-wave communication by a very simple configuration in which a transmission path of a high-frequency signal is configured by causing so-called plastics to be in contact with each other.

In a signal processing module 320B of a second example illustrated in FIG. 3(B), a semiconductor chip 323 having a primary function as the signal processing module 320B is arranged on the high-frequency signal waveguide 334. In the vicinity of the semiconductor chip 323 within the high-frequency signal waveguide 334, the high-frequency signal coupling structure 344 (corresponding to the transmission path coupling unit 108 or 208) having a function of transferring (coupling) a high-frequency signal (for example, an electrical signal of a millimeter-wave band) is configured. It is only necessary for the high-frequency signal coupling structure 344 to be electromagnetically coupled to the high-frequency signal waveguide 308 of the electronic device 300. For example, an antenna structure is adopted. While a patch antenna, an inverted-F antenna, a Yagi antenna, a probe antenna (dipole, etc.), a loop antenna, a small aperture-coupled device (slot antenna, etc.), or the like may be adopted as the antenna structure, among these, an antenna structure regarded to be a substantially planar antenna may be preferably adopted.

Preferably, the entire signal processing module 320B is not necessarily molded by a resin or the like. Incidentally, even in the case of molding, preferably, the side opposite the semiconductor chip 323 (an installation surface side for the high-frequency signal waveguide 308) may be flat, to be easily arranged on the high-frequency signal waveguide 308 of the electronic device 300, and, more preferably, a portion of the high-frequency signal coupling structure 342 may be exposed. If the signal processing module 320B of this structure is installed so that the high-frequency signal waveguide 308 is arranged facing a lower part of the high-frequency signal coupling structure 344, it is possible to transmit a high-frequency signal from the semiconductor chip 323 to the high-frequency signal waveguide 308 via the high-frequency signal waveguide 334 and the high-frequency signal coupling structure 344.

In a signal processing module 320C of a third example illustrated in FIG. 3(C), a high-frequency signal coupling structure (corresponding to the transmission path coupling unit 108 or the transmission path coupling unit 208) having a transfer (coupling) of the high-frequency signal (for example, an electrical signal of a millimeter-wave band) of the antenna structure or the like is configured within a semiconductor chip 324 (corresponding to the semiconductor chip 103 or 203) having a primary function as the signal processing module 320C. Substantially, the signal processing module 320C is constituted of the semiconductor chip 324 itself. Although a substantially planar antenna such as a patch antenna or an inverted-F antenna is preferably provided as the antenna structure of the high-frequency signal coupling structure 346, the present disclosure is not limited thereto. A Yagi antenna, a probe antenna (dipole, etc.), a loop antenna, a small aperture-coupled device (slot antenna, etc.), or the like, may be provided.

Preferably, the entire semiconductor chip 324 is not necessarily molded by a resin or the like. Incidentally, even in the case of molding, preferably, an installation surface side for the high-frequency signal waveguide 308 may be flat, to be easily arranged on the high-frequency signal waveguide 308 of the electronic device 300, and, more preferably, a portion of the high-frequency signal coupling structure 346 may be exposed. If the signal processing module 320C of this structure is installed so that the high-frequency signal waveguide 308 is arranged facing a lower part of the high-frequency signal coupling structure 346, it is possible to transmit a high-frequency signal from the semiconductor chip 324 to the high-frequency signal waveguide 308 via the high-frequency signal coupling structure 346.

In a signal processing module 320D of a fourth example illustrated in FIG. 3(D), the signal processing module 320C (substantially the semiconductor chip 324) of the third example illustrated in FIG. 3(C) is arranged on the high-frequency signal waveguide 334. Preferably, the entire signal processing module 320D is not necessarily molded by a resin or the like. Incidentally, even in the case of molding, preferably, a portion of the high-frequency signal coupling structure 334 may be exposed. If the signal processing module 320D of this structure is installed so that the high-frequency signal waveguide 308 is arranged facing a lower part of the high-frequency signal coupling structure 334, it is possible to transmit a high-frequency signal from the semiconductor chip 324 to the high-frequency signal waveguide 308 via the high-frequency signal waveguide 334.

[Directivity of High-Frequency Signal Coupling Structure]

Even in the first example illustrated in FIG. 3(A) to the fourth example illustrated in FIG. 3(D), the directivity of the high-frequency signal coupling structure may be either a horizontal direction (a longitudinal direction or a planar direction of the high-frequency signal waveguide 308) or a vertical direction (a thickness direction of the high-frequency signal waveguide 308). For example, a dipole antenna or a Yagi antenna is arranged on the plate-like high-frequency signal waveguide 332. The directivity of the antenna is in the planar direction of the high-frequency signal waveguide 332, and a radiated high-frequency signal is coupled to the high-frequency signal waveguide 308 in the horizontal direction and transmitted within the high-frequency signal waveguide 308. Power of a high-frequency signal transmitted within the high-frequency signal waveguide 308 in the horizontal direction is strong in a traveling direction and weakens according to separation from the traveling direction. Further, when a distance from a high-frequency transmission path increases, attenuation of the high-frequency signal due to loss (for example, dielectric loss) increases. Accordingly, even when a plurality of signal processing modules 320 are arranged when the high-frequency signal waveguide 308 is one dielectric plate, it is possible to separate the high-frequency transmission path using the directivity and the attenuation and transmit a high-frequency signal toward a desired signal processing module 320. Although a degree of electromagnetic coupling with the high-frequency signal waveguide 308 is inferior compared to the directivity of the vertical direction, the efficiency of transmitting a high-frequency signal within the high-frequency signal waveguide 308 in the horizontal direction is superior.

On the other hand, coupling of longitudinal waves using an antenna having vertical directivity is preferred in that electromagnetic coupling of a high-frequency signal between the signal processing module 320 and the high-frequency signal waveguide 308 is accomplished. It is possible to perform coupling of longitudinal electromagnetic waves and perform coupling only when contract is made. For example, a patch antenna or a slot antenna is arranged on the plate-like high-frequency signal waveguide 332. The directivity of the patch antenna or the like is the vertical direction of the high-frequency signal waveguide 308, and a radiated high-frequency signal is coupled to the high-frequency signal waveguide 308 in the vertical direction (thickness direction) and transmitted within the high-frequency signal waveguide 308 by changing the direction to the horizontal direction. Although a degree of electromagnetic coupling to the high-frequency signal waveguide 308 is superior compared to the directivity of the horizontal direction, the efficiency of transmitting a high-frequency signal within the high-frequency signal waveguide 308 in the horizontal direction is inferior.

COMPARATIVE EXAMPLES

Figure 4:
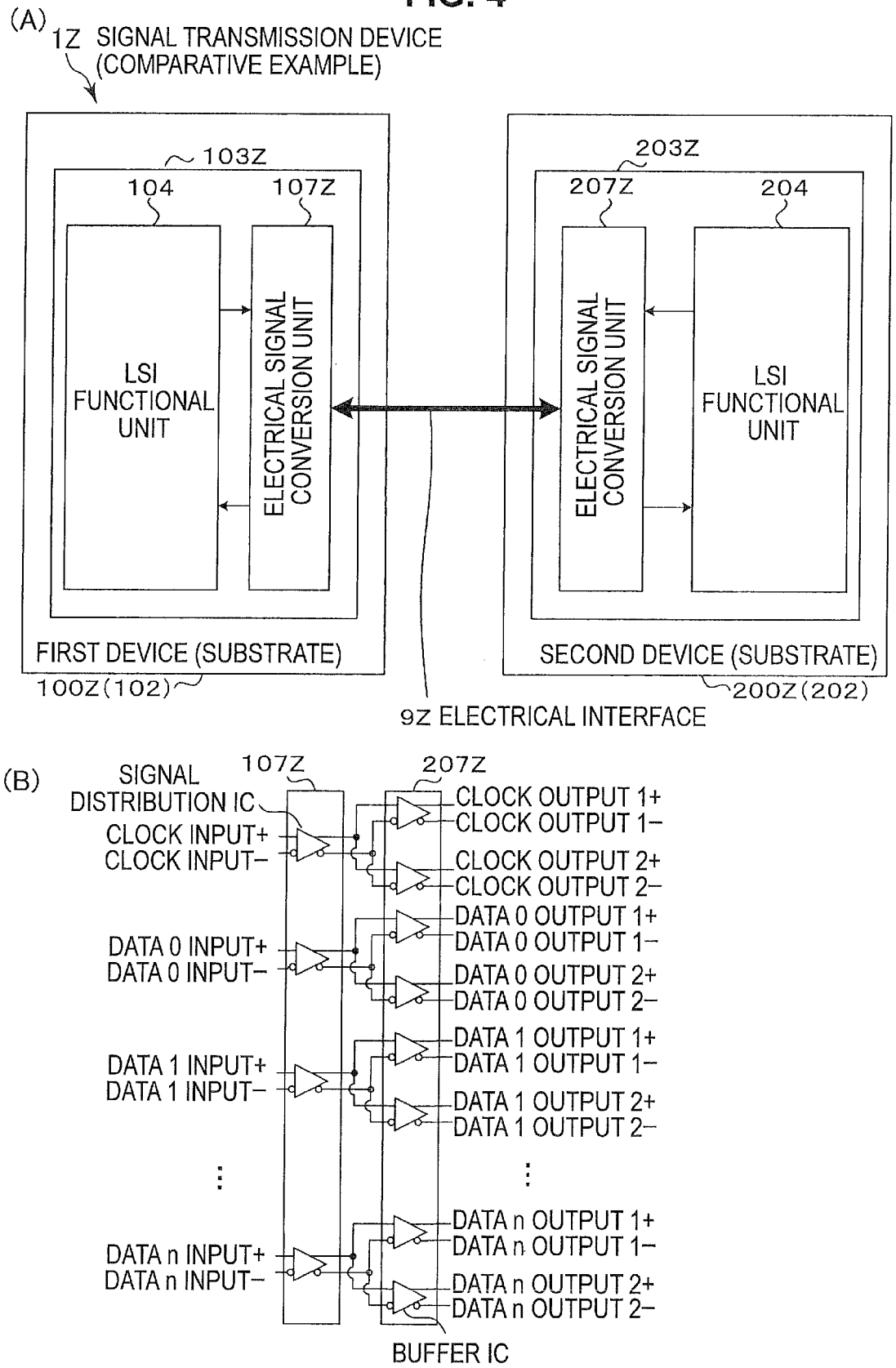
FIGS. 4(A) and 4(B) are diagrams illustrating a signal interface of a signal transmission device of a comparative example from the point of view of a functional configuration.

FIG. 4 is a diagram illustrating a signal interface of a signal transmission device of a comparative example from the point of view of a functional configuration. In FIG. 4(A), the overall outline is illustrated. A signal transmission device 1Z of the comparative example is configured so that a first device 100Z and a second device 200Z are coupled via an electrical interface 9Z and perform signal transmission. A semiconductor chip 103Z capable of signal transmission via electrical wiring is provided in the first device 100Z. Likewise, a semiconductor chip 203Z capable of signal transmission via electrical wiring is provided in the second device 200Z. A configuration in which the millimeter-wave signal transmission path 9 of the first embodiment is replaced with the electrical interface 9Z is made. Because signal transmission is performed via the electrical wiring, an electrical signal conversion unit 107Z is provided in the first device 100Z instead of the signal generation unit 107 and the transmission path coupling unit 108, and an electrical signal conversion unit 207Z is provided in the second device 200Z instead of the signal generation unit 207 and the transmission path coupling unit 208. In the first device 100Z, the electrical signal conversion unit 107Z performs electrical signal transmission control via the electrical interface 9Z for an LSI functional unit 104. On the other hand, in the second device 200Z, the electrical signal conversion unit 207Z is accessed via the electrical interface 9Z and obtains data transmitted from the side of the LSI functional unit 104.

For example, in an electronic device using a solid-state imaging device such as a digital camera, the solid-state imaging device is arranged in the vicinity of an optical lens, and various signal processing operations, such as image processing, compression processing, image storage, performed on an electrical signal from the solid-state imaging device are usually processed in a signal processing circuit outside the solid-state imaging device. For example, technology for transmitting an electrical signal at a high speed is necessary to cope with a large number of pixels and a high frame rate between the solid-state imaging device and the signal processing circuit. For this, low-voltage differential signaling (LVDS) is usually used. Although a matched impedance termination is necessary to accurately transmit an LVDS signal, it is necessary to equally maintain a mutual wiring length so that a wiring delay is sufficiently small to transmit a plurality of LVDS signals whose synchronization is necessary in a situation in which an increase in power consumption is also not ignorable. Although action such as increasing the number of LVDS signal lines is accomplished to transmit an electrical signal at a higher speed, difficulty in designing a printed wiring board increases, and complexity of a printed wiring board or cable wiring, and an increase in the number of terminals for wiring between the solid-state imaging device and the signal processing circuit, become problematic from the point of view of size reduction and low cost. Further, increasing the number of signal lines causes the following new problem. Increasing the number of lines increases the cost of a cable or a connector.

Although a mechanism of camera shake correction due to movement of a solid-state imaging device has been proposed in JP 2003-110919A, a load of an actuator for warping a cable for transferring an electrical signal is problematic. On the other hand, in JP 2006-352418A, the load of the actuator is reduced using wireless transmission. Although signals from a plurality of solid-state imaging devices and processing thereon are necessary for generation of multiview images (see JP H09-27969A) or three-dimensional moving-image data, the number of transmission paths using high-speed transmission technology within a device further increases in this case.

Also, when a transmission rate of a video information device (audio/video (AV) device) such as a television or a recorder increases and a function of data transmission or the like is necessary, it is necessary to pre-mount a necessary wiring, connector, functional IC, or the like. When an additional function has been generated after design completion, a product commercialization time associated with a design change of a main board is delayed or cost is increased. For example, an IC for wiring, a connector, data transmission, and control, as a function extension, is prepared on the main board. When the function extension is necessary, the mount or connector wiring is made, resulting in an increase in a substrate area or an increase in cost.

Also, a user of a personal computer can make a function extension using a universal serial bus (USB) module, a personal computer memory card international association (PCI-MCA) card, or the like, having a necessary function, after purchasing a product, and there is also a need for introduction thereof into a video information device. Incidentally, in the function extension using a standard USB or personal computer (PC) card in the field of the PC, installation may be difficult due to restrictions of a size or an extraction place of a product in addition to a factor of the increase in the substrate area or the increase in the cost. Also, there is a drawback in that a data compression or rate conversion function IC is separately necessary for use in high-speed data transmission at several gigabits per seconds (Gbps).

In JP 2003-179821A, technology for simply changing a function of a device or adding a module without change in an internal wiring or a connection in a signal cable by transmitting data through wireless communication between two signal processing means has been proposed. However, in this method, a wireless signal is reflected by a member within the device or a housing, and there is inconvenience in data transmission. For example, a module, a substrate, a connector, and a radiator version of a material that generates multipath and attenuates a wireless signal are complexly arranged, and quality of the wireless signal is significantly deteriorated. Thus, in order to establish necessary communication, power of a transmitter is increased and a configuration of a reception side is complex, causing an increase in power consumption of a wireless function, an increase in a size, and an increase in cost, and interference of radio waves is received from outside of the device. Conversely, radiation outside of the device is generated and hence there is also concern about causing interference with other devices.

On the other hand, according to the embodiment 1, the electrical signal conversion unit 107Z and the electrical signal conversion unit 207Z of the comparative example are replaced with the signal generation unit 107 and the signal generation unit 207, and the transmission path coupling unit 108 and the transmission path coupling unit 208, so that signal transmission is performed as a high-frequency signal (for example, a millimeter-wave band) instead of electrical wiring. A transmission path of a signal is changed from wiring to an electromagnetic transmission path. A connector or cable used in signal transmission by electrical wiring is not used, so that the effect of cost reduction is generated. It is not necessary to consider reliability related to a connector or cable, so that the effect of improving the reliability of a transmission path is generated. Although a space or an assembly time for engagement is necessary when a connector or cable is used, a high-frequency signal transmission is used, so that an assembly space is not used and a size of the device can be reduced. A production time can be reduced because the assembly time can be reduced.

In particular, in the embodiment 1, the high-frequency signal waveguide capable of transmitting radio waves such as millimeter waves with low loss is provided within an electronic device, and a signal processing module having a transmission path coupling unit (coupler) is placed on the high-frequency signal waveguide when a configuration change is necessary, so that data transmission is performed by transmitting electromagnetic waves such as millimeter waves through an inside of the high-frequency signal waveguide. At the time of the configuration change, such as function addition, the signal processing mode can be added without making a design change in a main board or the like.

Compared to the connection of the electrical wiring, an error of several millimeters to several centimeters can be allowed without specifying a pin arrangement or a contact position as for a connector of electrical wiring in arrangements of the high-frequency signal waveguide and the transmission path coupling unit (so-called coupler). The transmission path coupling unit electromagnetically couples a high-frequency signal to the high-frequency signal waveguide, so that power of the transmitter is reduced, because it is possible to reduce loss of electromagnetic waves compared to a general wireless connection including wireless communication in an outdoor field. Because a configuration of a reception side can be simplified, power consumption of a communication function can be reduced, a size of the communication function can be reduced, and cost of the communication function can be reduced. Compared to the general wireless connection including the wireless communication in the outdoor field, the cost or size necessary to prevent interference can be reduced, because interference of radio waves from outside of the device and, conversely, radiation to the outside of the device, can be suppressed.

[Embodiment 2]

Figure 5:
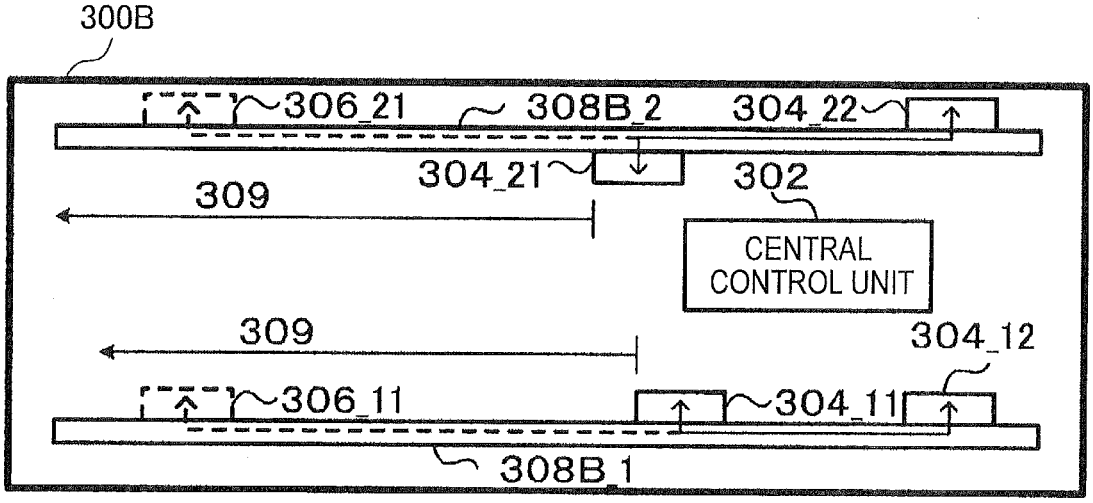
FIG. 5 is a diagram illustrating an outline of the overall configuration of an electronic device of an embodiment 2.
Figure 6:
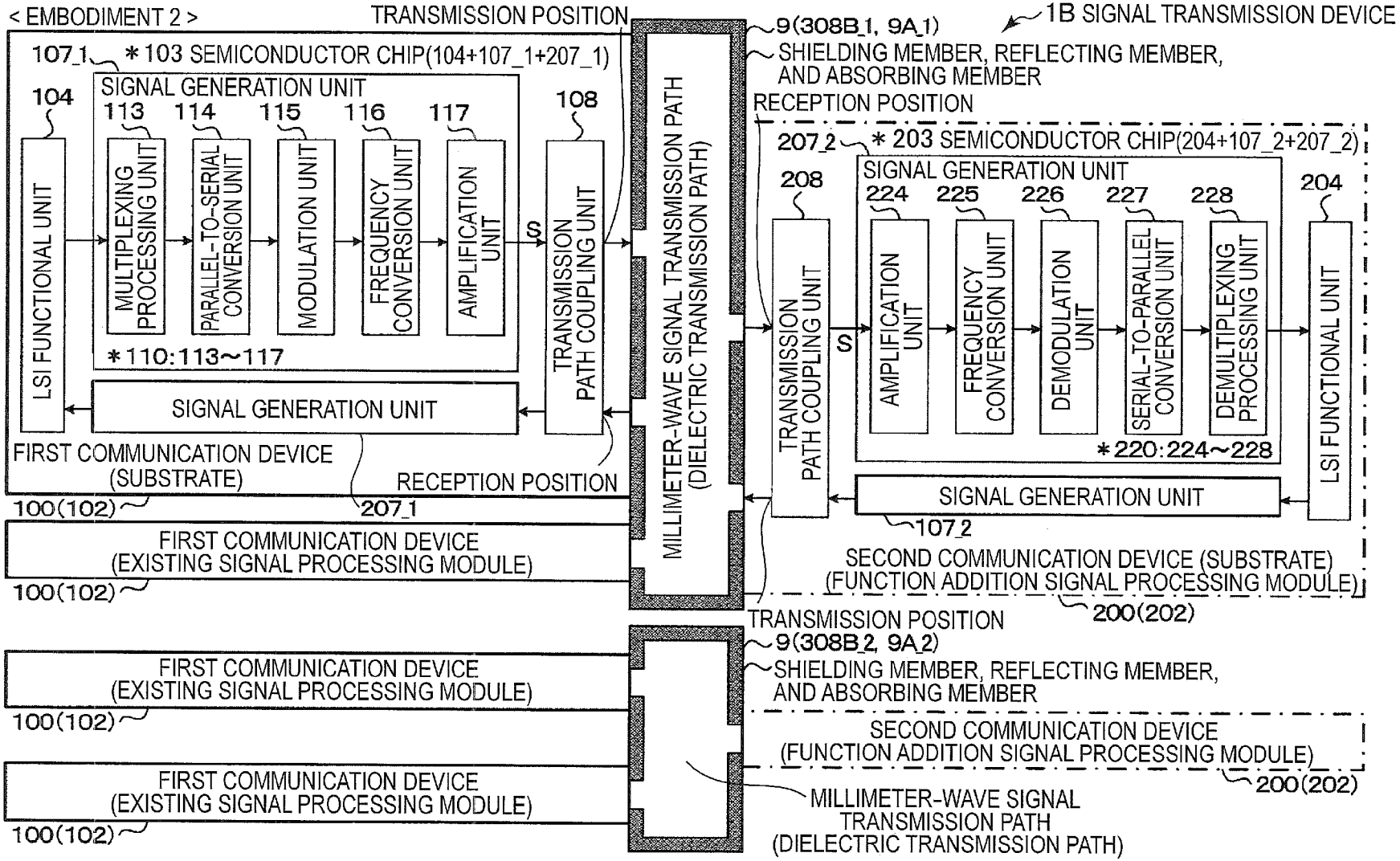
FIG. 6 is a diagram illustrating a signal interface of a signal transmission device of the embodiment 2 installed in an electronic device of an example from the point of view of a functional configuration.

FIGS. 5 and 6 are diagrams illustrating an electronic device of the embodiment 2 in which the signal transmission device of this embodiment is installed. Here, FIG. 5 is a diagram illustrating an outline of an overall configuration of the electronic device 300B of the embodiment 2. FIG. 6 is a diagram illustrating a signal interface of the signal transmission device 1B of the embodiment 2 installed in the electronic device 300B of the embodiment 2 from the point of view of a functional configuration. In other words, FIG. 6 is a functional block diagram focused on a communication process in the electronic device 300B.

The electronic device 300B of the embodiment 2 includes a central control unit 302, which controls the overall operation of the device, and a high-frequency signal waveguide 308B. Here, the electronic device 300B is different from that of the embodiment 1 in that a plurality of high-frequency signal waveguides 308 are provided. Although two high-frequency signal waveguides 308B_1 and 308B_2 of the high-frequency signal waveguides 308 are shown in the drawing, the number thereof is not limited to 2. Others are substantially the same as in the embodiment 1. Incidentally, although the high-frequency signal waveguides 308B_1 and 308B_2 have a linear shape or a planar shape in the drawing, the present disclosure is not limited thereto. A high-frequency signal waveguide may be bent as illustrated in FIG. 1(B) of the embodiment 1.

In the electronic device 300B, one or more existing signal processing modules 304 are mounted on each of the high-frequency signal waveguides 308B_1 and 308B_2. For example, in the illustrated example, existing signal processing modules 304_11 and 304_12 are mounted on the existing signal processing module 304B_1, and existing signal processing modules 304_21 and 304_22 are mounted on the existing signal processing module 304B_2. Accordingly, an additional module mounting region 309, in which a configuration change signal processing module 306 capable of processing communication in the millimeter-wave band when a function change is made can be mounted, is provided in each of the existing signal processing modules 304B_1 and 304B_2. When the configuration change signal processing module 306 is added later, the configuration change signal processing module 306 is installed in the additional module mounting region 309, in a state in which there is an existing signal processing module 304 installed in advance on the existing signal processing module 304B_1 or 304B_2, so that high-speed/large-volume millimeter wave communication is established via the high-frequency signal waveguide 308B_1 or 308B_2. Thereby, high-speed data transmission using millimeter waves is performed with low loss. In particular, according to the embodiment 2, it is possible to perform independent communication of a plurality of sets even when the same carrier frequency is used, by preparing the plurality of high-frequency signal waveguides 308.

[Embodiment 3]

Figure 7:
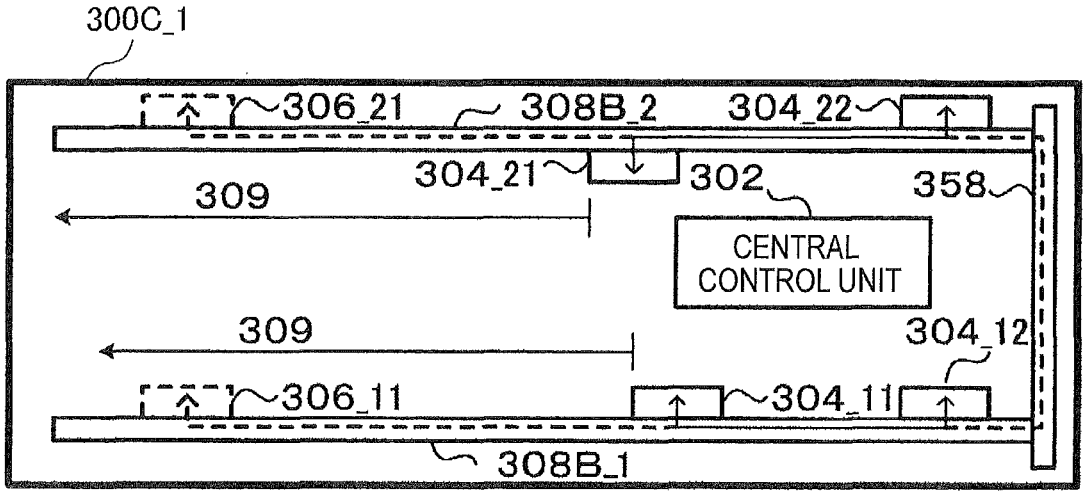
FIGS. 7(A) and 7(B) are diagrams illustrating an outline of the overall configuration of an electronic device of an embodiment 3.
Figure 7:
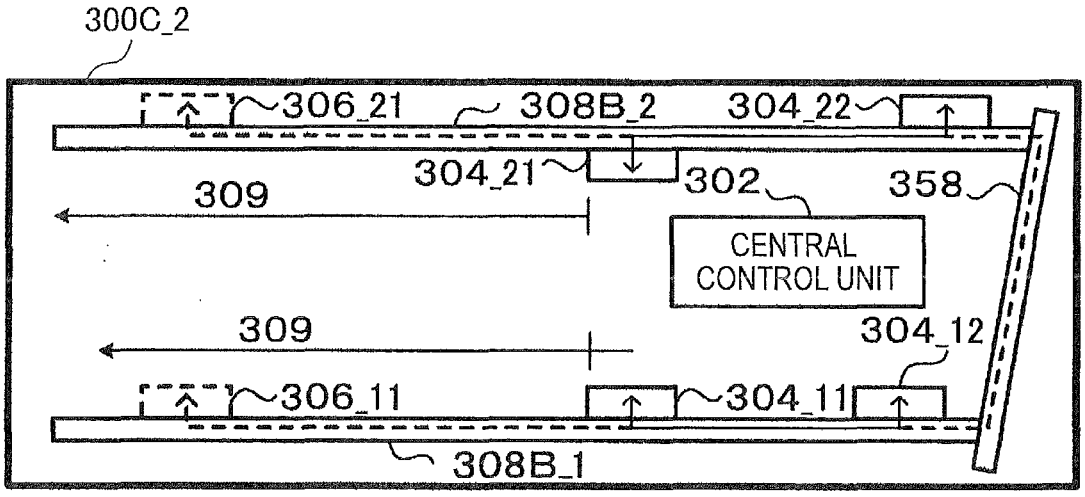
Figure 8:
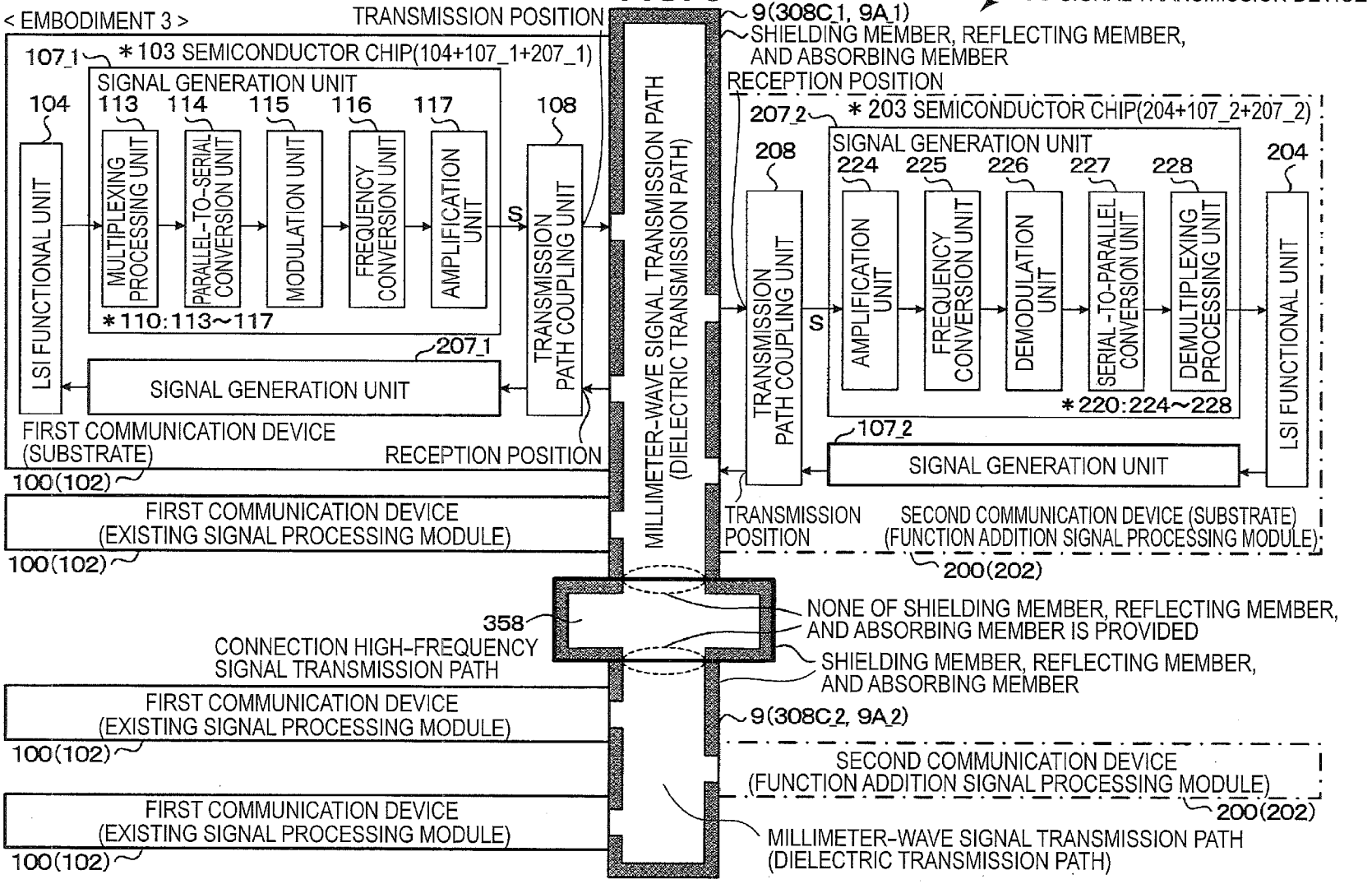
FIG. 8 is a diagram illustrating a signal interface of a signal transmission device of the embodiment 3 installed in the electronic device of the embodiment 3 from the point of view of a functional configuration.

FIGS. 7 and 8 are diagrams illustrating an electronic device of the embodiment 3 in which the signal transmission device of this embodiment is installed. Here, FIG. 7 is a diagram illustrating an outline of the overall configuration of the electronic device 300C of the embodiment 3. FIG. 8 is a diagram illustrating a signal interface of a signal transmission device 1C of the embodiment 3 installed in the electronic device 300C of the embodiment 3, from the point of view of a functional configuration. In other words, FIG. 8 is a functional block diagram focused on a communication process in the electronic device 300C.

The electronic device 300C of the embodiment 3 is characterized in that a connection high-frequency signal waveguide (represented as a connection high-frequency signal waveguide 358) that electromagnetically connects (couples) a plurality of high-frequency signal waveguides 308 is attachable/detachable based on the electronic device 300B of the embodiment 2 in which the plurality of high-frequency signal waveguides 308 are provided. The existing signal processing modules 304_11 and 304_12 are mounted on an existing signal processing module 304C_1, and the existing signal processing modules 304_21 and 304_22 are mounted on an existing signal processing module 304C_2. Incidentally, although high-frequency signal waveguides 308C_1 and 308C_2 have a linear shape or a planar shape in the drawing, the present disclosure is not limited thereto. A high-frequency signal waveguide may be bent as illustrated in FIG. 1(B) of the embodiment 1.

When the configuration change signal processing module 306 is added later, the configuration change signal processing module 306 is installed in the additional module mounting region 309, in a state in which there is an existing signal processing module 304 installed in advance on the existing signal processing module 304C_1 or 304C_2 as in the above embodiment 2. Further, in the embodiment 3, an arrangement is made by causing the connection high-frequency signal waveguide 358 to be in contact with the existing signal processing modules 304C_1 and 304C_2. When unnecessary, it is possible to remove the connection high-frequency signal waveguide 358. For example, although the two high-frequency signal waveguides 308C_1 and 308C_2 have substantially the same size and are provided to substantially face each other within the housing in the electronic device 300C_1 of the first example illustrated in FIG. 7(A), the two high-frequency signal waveguides 308C_1 and 308C_2 are substantially vertically arranged by causing the connection high-frequency signal waveguide 358 to be in contact with each end (the right end side of the drawing). In the electronic device 300C_2 of the second example illustrated in FIG. 7(B), sizes of the two high-frequency signal waveguides 308C_1 and 308C_2 are different and the connection high-frequency signal waveguide 358 is obliquely arranged, so that electromagnetic coupling of a high-frequency signal is accomplished by causing the connection high-frequency signal waveguide 358 to be in contact with the two high-frequency signal waveguides 308C_1 and 308C_2. Incidentally, a shielding member, a reflecting member, and an absorbing member are not provided so that contact portions between the high-frequency signal waveguides 308C_1 and 308C_2 and the connection high-frequency signal waveguide 358 do not have a negative effect on electromagnetic coupling.

Thereby, the high-frequency signal (for example, an electrical signal of the millimeter-wave band) is also transmitted between the existing signal processing modules 304C_1 and 304C_2 via the connection high-frequency signal waveguide 358. In the electronic device 300C of the above-described embodiment 3, high-speed/high-volume millimeter-wave communication can be established via the high-frequency signal waveguide 308C_1, the high-frequency signal waveguide 358, and the high-frequency signal waveguide 308C_2, when a configuration is changed. It is possible to make a change to the form of the embodiment 2 by removing the connection high-frequency signal waveguide 358.

[Embodiment 4]

Figure 9:
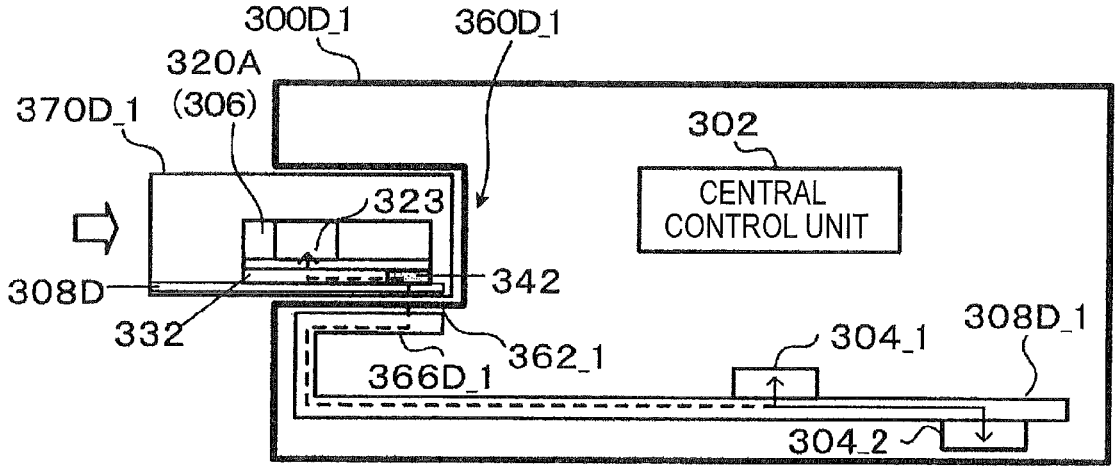
FIGS. 9(A) and 9(B) are diagrams illustrating an electronic device of an embodiment 4.
Figure 9:
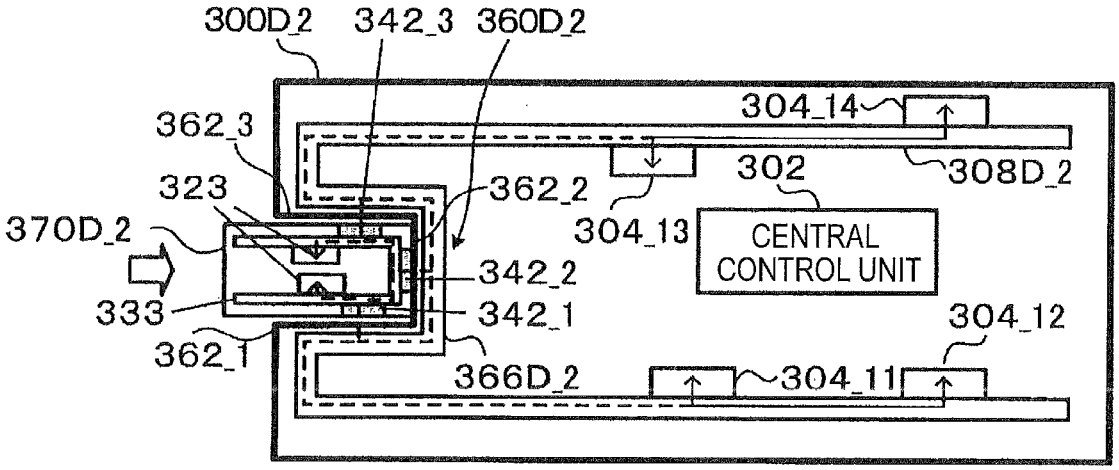

FIG. 9 is a diagram illustrating an electronic device of the embodiment 4 in which a signal transmission device of this embodiment is installed. The embodiment 4 is characterized in that the high-frequency signal waveguide is arranged in a portion into which a throttle provided in an additional module is inserted in a housing having a slot structure into which the additional module is inserted. For example, an electronic device 300D_1 of a first example illustrated in FIG. 9(A) is a modified example of the electronic device 300A_1 of the first example illustrated in FIG. 1(A), and a slot structure 360D_1 is provided on the left of the drawing. Although there is provided a high-frequency signal waveguide 308D_1 on which existing signal processing modules 304 (an example of two modules in the drawing) have been installed within a housing, the high-frequency signal waveguide 308D_1 extends in parallel along one wall surface 362 of a concave portion of the slot structure 360D_1. A portion facing one wall surface 362_1 of the slot structure 360D_1 of the high-frequency signal waveguide 308D_1 is referred to as a slot coupling unit 366D_1.

In a configuration change unit 370D_1, the high-frequency signal waveguide 308 is arranged along the housing, and a configuration change signal processing module 306 is installed on the high-frequency signal waveguide 308 thereof. When the function change is made, a configuration change unit 370D_1 in which the configuration change signal processing module 306 (the signal processing module 320) capable of performing a communication process in the millimeter-wave band is housed is mounted in the slot structure 360D_1. At this time, the high-frequency signal coupling structure of the signal processing module 320 is mounted facing the slot coupling unit 366D_1 of the high-frequency signal waveguide 308D_1 (in detail, so that a high-frequency signal can be electromagnetically coupled). Although an example in which a signal processing module 320A of the first example is used as the configuration change signal processing module 306 is illustrated in the drawing, the present disclosure is not limited thereto. It may be the signal processing module 320B of the second example, the signal processing module 320C of the third example, or the signal processing module 320D of the fourth example. Communication of millimeter waves transmitted through the high-frequency signal waveguide 308D_1 between the existing signal processing module 304 and the configuration change signal processing module 320A is established and high-speed data transmission can be performed with reduced multipath, transmission degradation, and unnecessary radiation.

An electronic device 300D_2 of a second example illustrated in FIG. 9(B) is a modified example of the electronic device 300A_2 of the second example illustrated in FIG. 1(B). On the left of the drawing, a slot structure 360D_2 is provided. Although there is provided a high-frequency signal waveguide 308D_2 on which existing signal processing modules 304 (an example of four modules in the drawing) are installed within a housing, the high-frequency signal waveguide 308D_2 extends in parallel along three wall surfaces 362_1, 362_2, and 362_3 of a concave portion of the slot structure 360D_2. Portions facing the three wall surfaces 362_1, 362_2, and 362_3 of the slot structure 360D_2 of the high-frequency signal waveguide 308D_2 are referred to as a slot coupling unit 366D_2.

In the configuration change unit 370D_2, a high-frequency signal waveguide 333 is arranged along the housing, and a semiconductor chip 323 or a high-frequency signal coupling structure 342 is installed on the high-frequency signal waveguide 333 thereof. When the function change is made, the configuration change unit 370D_2 is mounted in the slot structure 360D_2 as in the first example. As the illustrated configuration change unit 370D_2, a modification of the signal processing module 320A serving as the configuration change signal processing module is used. Specifically, the configuration change unit 370D_2 includes the U-shaped high-frequency signal waveguide 333. On the high-frequency signal waveguide 333, semiconductor chips 323 (an example of two chips in the drawing) are installed and high-frequency signal coupling structures 342_1, 342_2, and 342_3 having a function of transferring (coupling) millimeter waves of an antenna structure or the like are arranged on three side surfaces opposite the semiconductor chip 323 of the high-frequency signal waveguide 333. Further, the configuration change unit 370D_2 is not limited to a modification of the signal processing module 320A of the first example, and may be a modification of the signal processing module 320B of the second example, the signal processing module 320C of the third example, or the signal processing module 320D of the fourth example. When mounted in the slot structure 360D_2, the configuration change unit 370D_2 is mounted so that the high-frequency signal coupling structures 342_1, 342_2, and 342_3 face directions corresponding to three surfaces of the slot coupling unit 366D_2 of the high-frequency signal waveguide 308D_2 (in detail, so that a high-frequency signal can be electromagnetically coupled). Thereby, communication of millimeter waves transmitted through the high-frequency signal waveguide 308D_2 between the existing signal processing module 304 and the configuration change unit 370D_2 is established, and high-speed data transmission can be performed with reduced multipath, transmission degradation, and unnecessary radiation. Compared to the first example, it is possible to reliably accomplish electromagnetic coupling because there are a plurality of positions of electromagnetic coupling to the high-frequency signal waveguide 308D_2.

[Embodiment 5]

Figure 10:
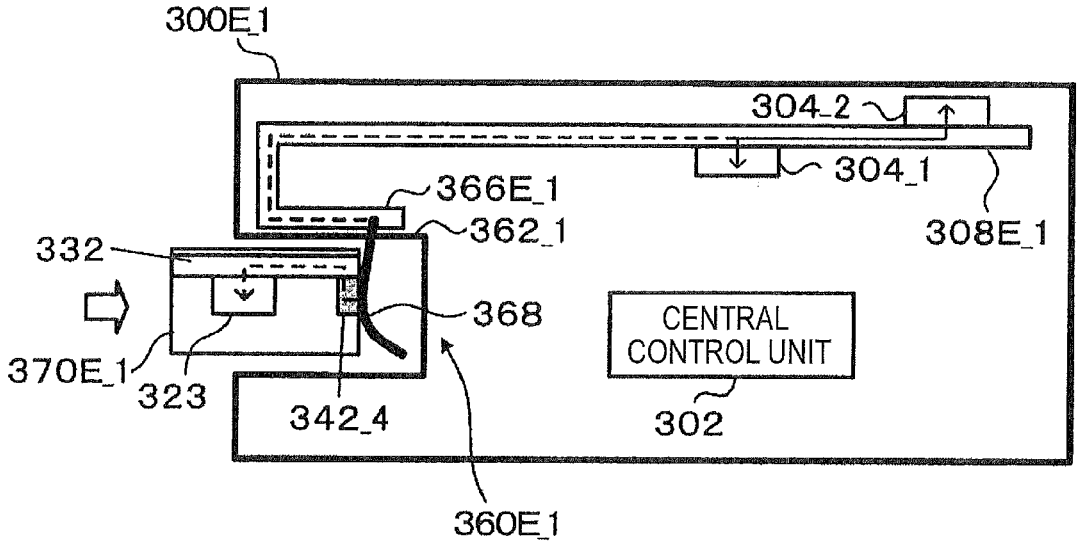
FIGS. 10(A) and 10(B) are diagrams illustrating an electronic device of an embodiment 5.
FIGS. 11(A) to 10(C) are diagrams illustrating an electronic device of an embodiment 6.
Figure 10:
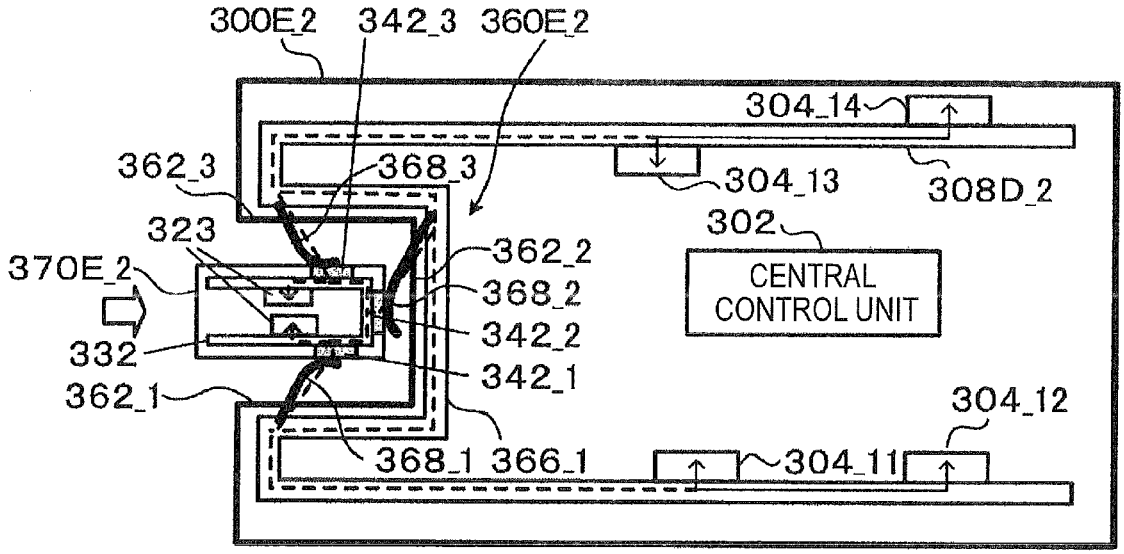

FIG. 10 is a diagram illustrating an electronic device of the embodiment 5, in which a signal transmission device of this embodiment is installed. The embodiment 5 is characterized in that a high-frequency signal waveguide is arranged in a portion into which a throttle is inserted in a housing having a slot structure (throttle) into which an additional module is inserted as in the embodiment 4. Here, the embodiment 5 is different from the embodiment 4 in that electromagnetic coupling to the high-frequency signal coupling structure of the additional module is accomplished using a flexible high-frequency signal waveguide.

An electronic device 300E_1 of a first example illustrated in FIG. 10(A) is a modified example of the electronic device 300D_1 of the embodiment 4 illustrated in FIG. 9(A). On the left of the drawing, a slot structure 360E_1 is provided. Although there is provided a high-frequency signal waveguide 308E_1 on which existing signal processing modules 304 (an example of two modules in the drawing) are installed within the housing, the high-frequency signal waveguide 308E_1 extends in parallel along one wall surface 362_1 of a concave portion of the slot structure 360E_1. A portion facing the one wall surface 362_1 of the slot structure 360E_1 of the high-frequency signal waveguide 308E_1 is referred to as a slot coupling unit 366E_1.

When the function change is made, a configuration change unit 370E_1 in which the configuration change signal processing module 306 (the signal processing module 320) capable of performing a communication process in the millimeter-wave band is housed is mounted in the slot structure 360E_1 as in the first example of the embodiment 4. Here, a difference from the electronic device 300D_1 of the first example of the embodiment 4 is that a flexible high-frequency signal waveguide 368 is further attached to the slot coupling unit 366E_1. The high-frequency signal waveguide 368 is an example of a contact high-frequency signal waveguide, and is attached in the vicinity of a tip end of the slot coupling unit 366E_1 to project to the concave portion of the slot structure 360E_1. The high-frequency signal waveguide 368 has a bent portion to project to the side of the configuration change unit 370E_1 without having a linear shape (or a planar shape).

As the illustrated configuration change unit 370_3, a signal processing module obtained by modifying the signal processing module 320A of the first example serving as the configuration change signal processing module 306 is used. Specifically, the configuration change unit 370E_1 includes a linear or planar high-frequency signal waveguide 332, and a semiconductor chip 323 (an example of one semiconductor chip in the drawing) is installed on the high-frequency signal waveguide 332. A high-frequency signal coupling structure 342_4 having a function of transferring (coupling) millimeter waves of an antenna structure or the like is arranged on the same surface as the semiconductor chip 323 of the high-frequency signal waveguide 332. Further, the configuration change unit 370E_1 is not limited to a modification of the signal processing module 320A of the first example, it may be a modification of the signal processing module 320B of the second example or the signal processing module 320C of the third example.

When the function change is made in the electronic device 300E_1 having the above-described configuration, the high-frequency signal coupling structure 342_4 comes in contact with the flexible high-frequency signal waveguide 368 when the configuration change unit 370E_1 is inserted into the slot structure 360E_1. Thereby, communication of millimeter waves transmitted through the high-frequency signal waveguide 308E_1 between the existing signal processing module 304 and the configuration change unit 370E_1 is established and high-speed data transmission can be performed with reduced multipath, transmission degradation, and unnecessary radiation. Compared to the first example of the embodiment 4, the high-frequency signal waveguide 368 is made flexible, so that high-speed/large-volume millimeter-wave communication is possible and more flexible function addition is possible without specifying a shape of an additional module (configuration change unit 370E_1) and a position of a millimeter-wave transfer function.

An electronic device 300E_2 of a third example illustrated in FIG. 10(B) is a modified example of the electronic device 300D_2 of the second example of the embodiment 4 illustrated in FIG. 9(B), and a flexible high-frequency signal waveguide 368 is attached to a slot coupling unit 366E_2 to project to a concave portion of a slot structure 360E_2 for each of three wall surfaces 362_1, 362_2, and 362_3 of the slot structure 360E_2. Each of high-frequency signal waveguides 368_1, 368_2, and 368_3 has a bent portion to project to the side of a configuration change unit 370E_2 without having a linear shape (or a planar shape).

When the function change is made in the electronic device 300E_2 of this configuration, the configuration change unit 370E_2 (similar to the configuration change unit 370D_2) is inserted into the slot structure 360E_2. Then, a high-frequency signal coupling structure 342_1 comes in contact with the flexible high-frequency signal waveguide 368_1, a high-frequency signal coupling structure 342_2 comes in contact with the flexible high-frequency signal waveguide 368_2, and a high-frequency signal coupling structure 342_3 comes in contact with the flexible high-frequency signal waveguide 368_3. Thereby, communication of millimeter waves transmitted through the high-frequency signal waveguide 308E_2 between the existing signal processing module 304 and the configuration change unit 370E_2 is established and high-speed data transmission can be performed with reduced multipath, transmission degradation, and unnecessary radiation. Compared to the first example, it is possible to reliably accomplish electromagnetic coupling because there are a plurality of positions of electromagnetic coupling to the high-frequency signal waveguide 308E_2.

Even in the first example and the second example in the embodiment 5, the high-frequency signal waveguide 308 is arranged in a housing including a throttle into which an additional module is inserted, and the flexible high-frequency signal waveguide 368 is installed in a portion into which the throttle is inserted. By inserting an additional function module having a function of transferring (coupling) millimeter waves of an antenna structure or the like from a slot, flexible function addition is possible without specifying a shape of an additional module and a position of a millimeter-wave transfer function.

[Embodiment 6]

Figure 11:
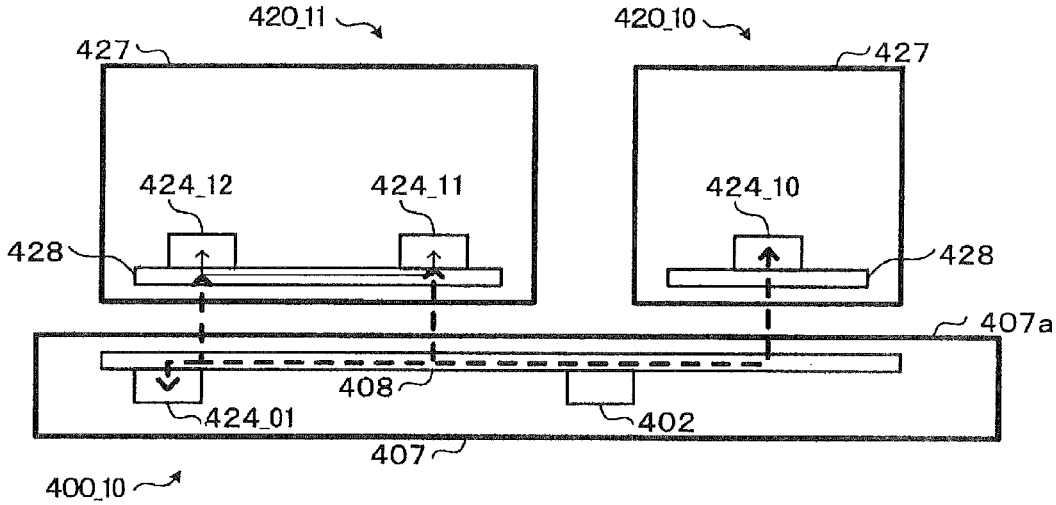
Figure 11:
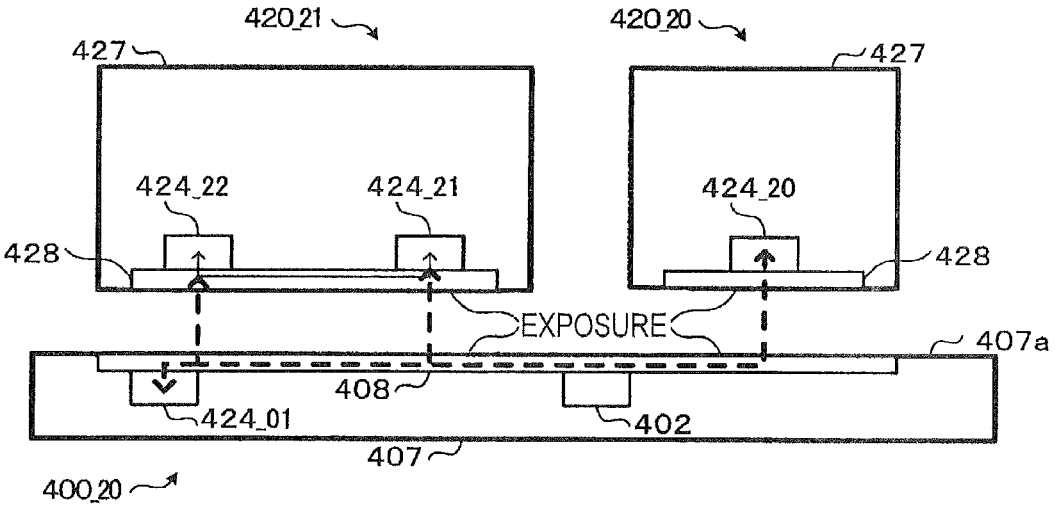
Figure 11:
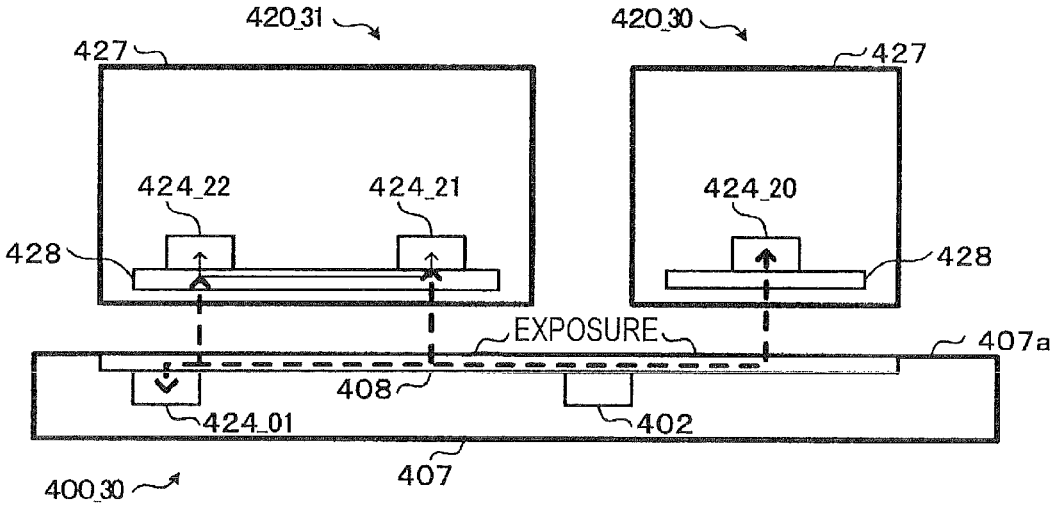

FIG. 11 is a diagram illustrating an electronic device of the embodiment 6 in which a signal transmission device of this embodiment is installed. The embodiment 6 is characterized in that a so-called cradle device is used as a first electronic device, a high-frequency signal waveguide is installed in a cradle device (an inside of the housing or a wall surface of the housing), and a portable electronic device is electromagnetically coupled to a high-frequency signal waveguide when a second electronic device (hereinafter also referred to as portable electronic device), such as a portable phone, a PHS, or a portable image reproduction device, is installed in the cradle device. The portable electronic device including a high-frequency signal waveguide and the signal processing module arranged thereon are arranged on the cradle device including the high-frequency signal waveguide, so that communication of a high-frequency signal (for example, an electrical signal of a millimeter-wave band) is established between signal processing modules of the portable electronic device. It is possible to use another portable electronic device as a function extension of one portable electronic device by transmitting data between different housings. Hereinafter, this will be specifically described.

The entire electronic device includes the cradle device 400 (first electronic device) and the portable electronic device 420 (second electronic device or mobile device). The cradle device 400 includes a high-frequency signal waveguide 408 serving as a high-frequency coupler which relays (couples) transmission of a high-frequency signal between signal processing modules. The cradle device 400 includes a mounting surface 407*a* on which another electronic device is mounted on an upper-surface side of the housing 407. The high-frequency signal waveguide 408 is arranged in parallel with the mounting surface 407*a*.

Although not indispensable, one or more signal processing modules 424 having a communication function (one signal processing module 424_01 in the drawing) may be provided on the high-frequency signal waveguide 408. The signal processing module 424 may be any of the signal processing module 320A of the first example, the signal processing module 320B of the second example, the signal processing module 320C of the third example, and the signal processing module 320D of the fourth example.

Although not indispensable, preferably, the central control unit 402 is arranged on the high-frequency signal waveguide 408 or at another position within the housing 407. When no central control unit 402 is provided, any of the portable electronic devices 420 may function as the central control unit 402. Although not illustrated, a server device may be responsible for the function of the central control unit 402 when the cradle device 400 is connected to the server device.

The central control unit 402 changes configuration information based on the portable electronic device 420 arranged in the vicinity of the high-frequency signal waveguide 408, and controls data transmission according to the changed configuration information. For example, when it is recognized that a combination configuration of the portable electronic devices 420 having the communication function has been changed, control is performed so that data transmission is performed between electronic devices suitable for the changed combination configuration of the portable electronic devices 420, signal processing modules within the cradle device 400, or CPUs (which may be central control units 402). It is only necessary to use general electrical wiring (a printed pattern, wire hardness, or the like) for a control or module recognition signal. For example, the central control unit 402 has an arrangement sensing unit configured to sense that the portable electronic devices 420 are closely arranged on an arrangement surface of the cradle device 400 (also including mounting for the mounting surface: hereinafter simply referred to as "arrangement") and a communication control unit configured to control each portable electronic device 420 when the arrangement sensing unit senses that a plurality of portable electronic devices 420 have been arranged on the mounting surface of the cradle device 400, and to control communication between the portable electronic devices 420. The arrangement sensing unit may include not only a function of sensing whether the portable electronic device 420 has been arranged in the cradle device 400, but also a function of recognizing an arrangement position or what has been arranged (the portable electronic device 420 or others). As a function of recognizing "what has been arranged," a function of recognizing a foreign object (in other words, a function of sensing whether there is a portable electronic device 420) as well as a function of identifying the portable electronic device 420 may also be included. The communication control unit may be in a power saving mode for a normal time based on a sensing result (also including a recognition result) of the arrangement sensing unit, and may return from the power saving mode when a communication process is necessary.

In order to implement a function of recognizing "what has been arranged," reflected waves of a signal transmitted from a module of the side of the cradle device 400 or a signal from an arranged device may be used. For example, if there is anything arranged on the mounting surface of the cradle device 400, reflected waves of a signal transmitted from the signal processing module 424_01 of the side of the cradle device 400 are changed and what has been arranged can be recognized. Further, when what has been arranged is a portable electronic device 420 including a signal processing module 424 having a communication function, a signal for identifying a signal processing module 424_10 or the like is transmitted to the side of the cradle device 400. Based on the signal, the central control unit 402 (arrangement sensing unit) can recognize "what has been arranged." When there is no reaction (no signal) from an arranged object (device), it is only necessary to determine the arranged object as a foreign object.

It is preferred for the high-frequency signal waveguide 408 to be formed of a dielectric material. It is possible to adopt various forms such as a form created by one dielectric plate, a form in which notches are formed in one dielectric plate, a form in which a plurality of openings are provided in one dielectric plate, and a form in which one transmission path is arranged in a spiral shape, as long as it is regarded to be a substantially planar shape. Further, the high-frequency signal waveguide 408 does not necessarily have a planar shape, and the dielectric transmission path may be formed to be three-dimensionally arranged.

The portable electronic device 420 includes a linear or planar high-frequency signal waveguide 428 serving as a high-frequency coupler which relays (couples) transmission of a high-frequency signal between signal processing modules. One or more signal processing modules 424 are mounted on the high-frequency signal waveguide 428. The signal processing module 424 may be any of the signal processing module 320A of the first example to the signal processing module 320D of the fourth example. Preferably, the signal processing module 424 is mounted to be in contact with the high-frequency signal waveguide 428. The signal processing module 424 performs its own predetermined signal processing, and performs signal processing while exchanging data between the signal processing modules 424 when a plurality of signal processing modules 424 are mounted.

The portable electronic device 420 is arranged (for example, installed) in the vicinity of the mounting surface of the cradle device 400, so that the portable electronic device 420 can transmit data via the high-frequency signal waveguide 408. The central control unit 402 manages configuration information before and after the portable electronic devices 420 are closely arranged, and controls data transmission according to changed configuration information. For example, before a certain portable electronic device 420 is closely arranged, configuration information indicating that a first function is implemented by performing data transmission between modules within the cradle device 400 is provided. In this state, when the certain portable electronic device 420 is arranged in the vicinity of the high-frequency signal waveguide 428 of the cradle device 400, it is also possible to perform data transmission to and from the portable electronic device 420, and a change to configuration information indicating that a new function can be implemented using this data transmission is made. Accordingly, a new function is implemented using the portable electronic device 420 closely arranged by controlling data transmission according to the changed configuration information. For example, data transmission between the signal processing module 424_01 and the portable electronic device 420 provided on the high-frequency signal waveguide 408 is possible. Also, high-speed/large-volume millimeter-wave communication is established between signal processing modules 424 within the housing 427 of the different portable electronic device 420. Communication between portable electronic devices 420 (for example, a portable phone and a digital camera) arranged on the cradle device 400 is possible. For one portable electronic device 420, another portable electronic device 420 can be handled as an external device. As a function extension of its own signal processing module 424, the signal processing module 424 of the portable electronic device 420 can be used. Because a high-frequency signal (electromagnetic waves) can be confined within the high-frequency signal waveguide 408, confidentiality of information can be protected better than in the case in which a space is used in the high-frequency signal waveguide. For example, it is possible to transmit data in the millimeter-wave band to and from any one of a signal processing module 424_n0 of a portable electronic device 420_n0, a signal processing module 424_n1 of a portable electronic device 420_n1, and a signal processing module 424_n2 of a portable electronic device 420_n2 (n is any of 1, 2, and 3). Because the high-frequency signal waveguide 408 can be simultaneously coupled to a plurality of portable electronic devices 420 (that is, high-frequency signal waveguides 428) if FDM or TDM is used, it is possible to transmit data in the millimeter-wave band to and from any one of the signal processing module 424_n0 of the portable electronic device 420_n0, the signal processing module 424_n1 of the portable electronic device 420_n1, and the signal processing module 424_n2 of the portable electronic device 420_n2 (n is any of 1, 2, and 3).

If the signal processing module is provided on the high-frequency signal waveguide 408 of the cradle device 400, or the cradle device 400 is connected to the server device, although not illustrated, high-speed/large-volume communication in the millimeter-wave band is possible by merely placing the portable electronic device 420 on the cradle device 400, and the portable electronic device 420 can be used as the external device for the function extension within the device or the external device of the server device. By unifying a communication standard of the device (signal processing module 424) within the portable electronic device 420, the portable electronic device 420, such as a digital camera arranged on the cradle device 400, can also perform server control, data management, or the like. Preferably, when the portable electronic device 420 has been arranged on the cradle device 400, if the central control unit 402 is provided, it is possible to implement functions such as a function of recognizing the portable electronic device 420 and recognizing a position in which the portable electronic device 420 has been arranged, a function of identifying the portable electronic device 420 including a high-frequency transmission/reception function and others (including a foreign object), and a function of setting a power saving mode for a normal time and returning from the power saving mode when the portable electronic device 420 including the high-frequency transmission/reception function is installed.

The portable electronic device 420 is installed in the cradle device 400, so that communication of millimeter waves transmitted through the high-frequency signal waveguide is established and high-speed data transmission can be performed with reduced multipath, transmission degradation, and unnecessary radiation. When a configuration change such as a function change is necessary, communication of millimeter waves transmitted through the high-frequency signal waveguide 408 can be established by arranging the portable electronic device 420 on the high-frequency signal waveguide 408 so that the high-frequency signal can be coupled (electromagnetically coupled). Incidentally, the dashed line of the drawing represents a transmission system of a high-frequency signal at the time of a configuration change (this is also similar in other embodiments described later). Thus, inter-device communication at which transmission is performed at a high speed can be easily implemented regardless of burdens, such as a design change, increase in a substrate area, or increase in cost, associated with a configuration change such as a function extension. For example, cheap plastic can also be used as the high-frequency signal waveguide. Because coupling is good, power consumption is low due to low loss, and a high-frequency signal (radio waves) is confined within the high-frequency transmission path, the effect of multipath is minor and the problem of EMC is also minor. An electromagnetic connection (coupling) is simple and coupling is possible in a broad range, and communication can be performed without inconvenience, even when a plurality of electronic devices are installed in one cradle device.

Although any of the signal processing modules 320 of the first to third examples illustrated in FIG. 3 may be adopted as the signal processing module 424, it is preferred to adopt a preferred one in view of an electromagnetic coupling state between the high-frequency signal waveguide 408 and the high-frequency signal waveguide 428. For example, in a first example illustrated in FIG. 11(A), the high-frequency signal waveguide 408 is housed within a housing 407 in a cradle device 400_10, and the high-frequency signal waveguide 428 is housed within a housing 427 in a portable electronic device 420_10 and a portable electronic device 420_11, so that the housings 407 and 427 and the space are sandwiched between the high-frequency signal waveguide 408 and the high-frequency signal waveguide 428. Because a high-frequency signal is electromagnetically coupled via the housings 407 and 427 and the space, in addition to the high-frequency signal waveguides 408 and 428, a high-frequency coupling structure of the signal processing module 424 has a structure corresponding thereto, such as an antenna structure. Any of the portable electronic device 420_10 and the portable electronic device 420_11 is only electromagnetically coupled when the high-frequency signal waveguide 428 (high-frequency coupler) comes in contact with the high-frequency signal waveguide 408 (high-frequency coupler) of the cradle device 400. Even when a distance between the high-frequency signal waveguide 428 and the high-frequency signal waveguide 308 is large and transmission paths (high-frequency couplers) are not in direct contact with each other, and even when the high-frequency signal waveguide 428 and the high-frequency signal waveguide 308 are in a non-contact (long distance) state using an antenna structure or the like as a high-frequency signal coupling structure, communication is possible.

In a second example illustrated in FIG. 11(B), the high-frequency signal waveguide 408 and the high-frequency signal waveguide 428 can be in direct contact, because the high-frequency signal waveguide 408 is exposed on a mounting surface side of the housing 407 in a cradle device 400_20, and the high-frequency signal waveguide 428 is exposed on the side of the cradle device 400 of the housing 427, in a portable electronic device 420_20 and a portable electronic device 420_21. Because the high-frequency signal is transmitted in a state in which the high-frequency signal waveguide 408 and the high-frequency signal waveguide 428 can be in direct contact, a dielectric material itself can be adopted as the high-frequency signal coupling structure of the signal processing module 424.

A third example illustrated in FIG. 11(C) is an intermediate state of the first example and the second example. While the high-frequency signal waveguide 408 is exposed from the housing 407 in a cradle device 400_30, the high-frequency signal waveguide 428 is housed within the housing 427 in portable electronic devices 420_30 and 420_31. Although not illustrated, a state in which the high-frequency signal waveguide 402 is housed within the housing 407 in the cradle device 400_30 and the high-frequency signal waveguide 408 is exposed from the housing 407 in the portable electronic devices 420_30 and 420_31 may be provided. In any case, for the portable electronic device 420, the housing 407 or 427 and the space are sandwiched between the high-frequency signal waveguide 408 and the high-frequency signal waveguide 428. Consequently, because a high-frequency signal is electromagnetically coupled via the housing 407 or 427 and the space in addition to the high-frequency signal waveguides 408 and 428, a high-frequency coupling structure of the signal processing module 424 has a structure corresponding thereto, such as an antenna structure.

Further, a power transmission unit is provided to wirelessly transmit power between the housing 407 (first housing) and the housing 427 (second housing), and power transmission as well as data transmission may be configured to be performed. Although either of a scheme (radio-wave reception type) in which no electromagnetic coil is used and a scheme (electromagnetic induction type or resonance type) in which an electromagnetic coil is used may be adopted when power transmission is wirelessly performed, it is preferred to adopt the scheme in which the electromagnetic coil is used. For example, it is possible to transmit power to the portable electronic device 420 placed in an arbitrary place on the cradle device 400 in a non-contact form by rectifying and extracting a received high-frequency signal as the radio-wave reception type. Alternatively, although not illustrated, a coil for power transmission is included within the housing 407 and both of data and power are transmitted/received according to the scheme in which the electromagnetic coil is used.

[Modified Examples of Embodiment 6]

Figure 12:
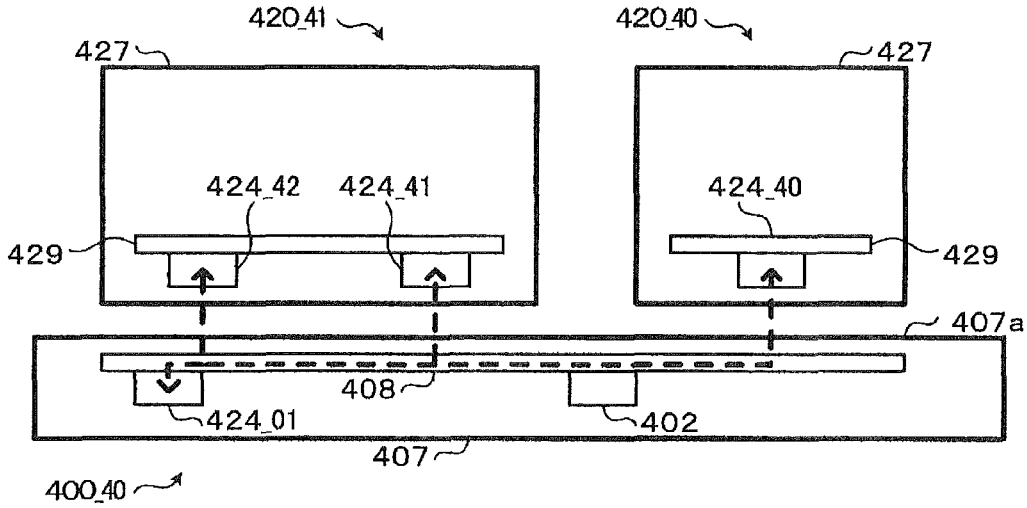
FIGS. 12(A) to 12(C) are diagrams (part 1) illustrating modified examples of the embodiment 6.
Figure 12:
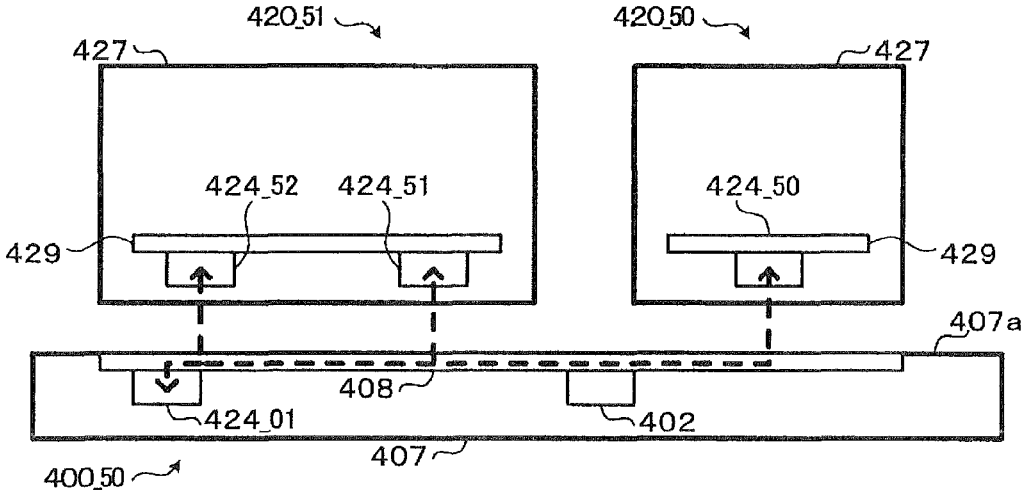
Figure 12:
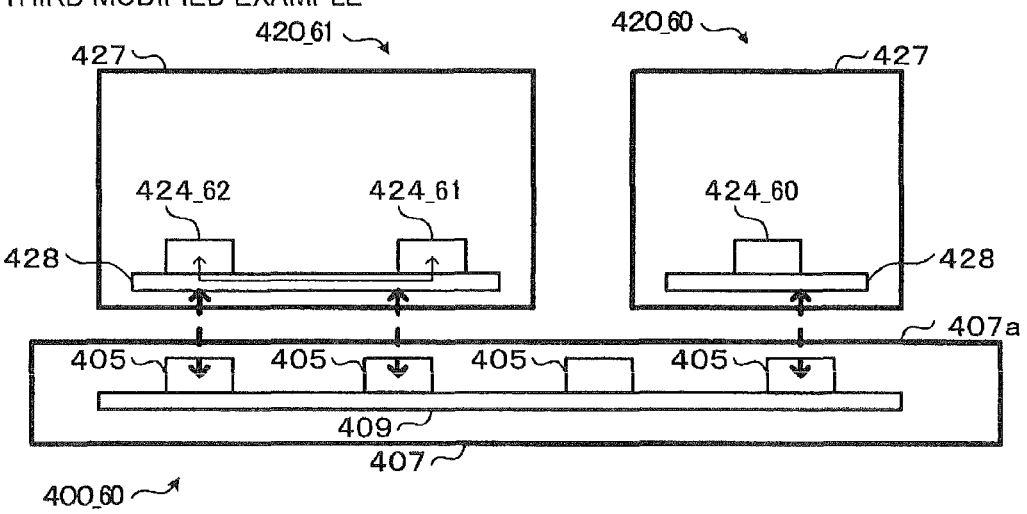
Figure 13:
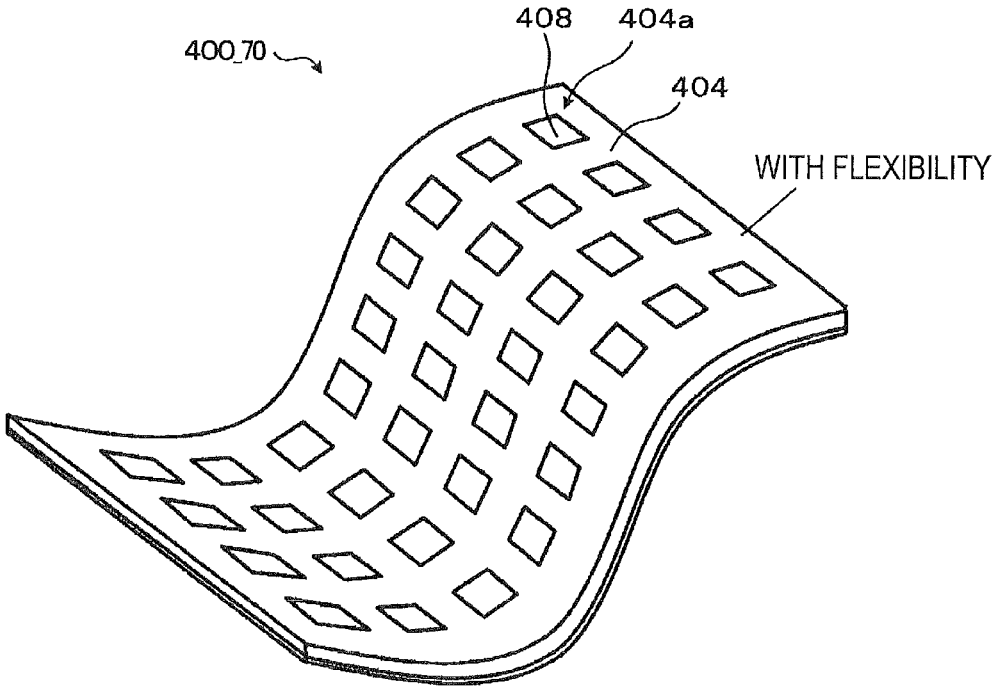
FIGS. 13(A) and 13(B) are diagrams (part 2) illustrating modified examples of the embodiment 6.
Figure 13:
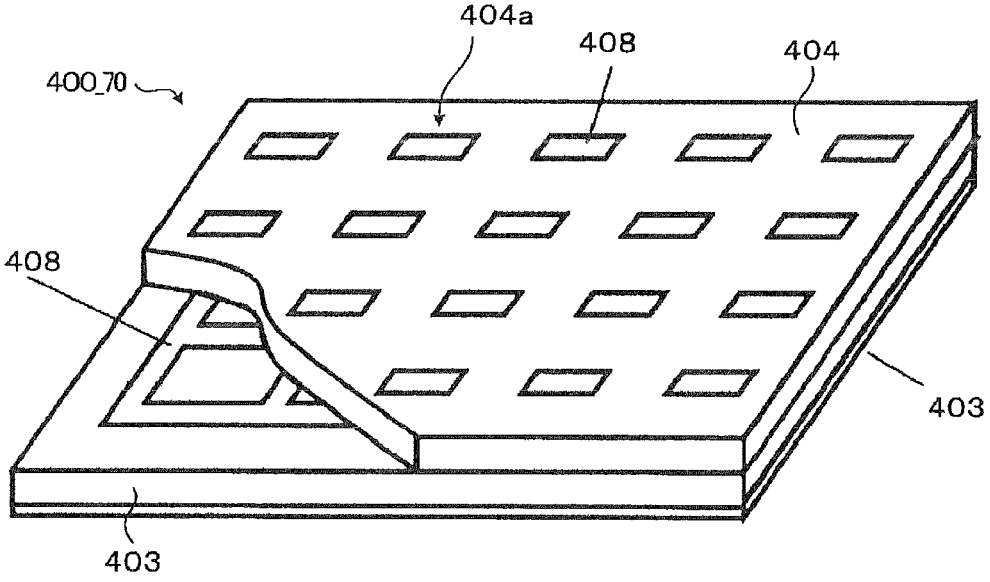

FIGS. 12 and 13 are diagrams illustrating the modified examples of the embodiment 6. In the above-described embodiment 5, the case in which the high-frequency signal waveguide is arranged in both of the cradle device 400 and the portable electronic device 420 has been described, but this is not the only case. Basically, it is only necessary to arrange the high-frequency signal waveguide in one side.

For example, in a first modified example illustrated in FIG. 12(A) and a second modified example illustrated in FIG. 12(B), the high-frequency signal waveguide 408 is arranged at only the side of the cradle device 400. Further, in a cradle device 400_40 of the first modified example, the high-frequency signal waveguide 408 is housed within the housing 407. In a cradle device 400_50 of the second modified example, the high-frequency signal waveguide 408 is exposed at the mounting surface side of the housing 407. The portable electronic device 420 includes a circuit substrate 429, and one or more signal processing modules 424 having a transmission/reception function are mounted on the side of the cradle device 400 of the circuit substrate 429. The signal processing module 424 performs its own predetermined signal processing, and performs signal processing while exchanging data between the signal processing modules 424 via electrical wiring (including a circuit pattern) when a plurality of signal processing modules 424 are mounted. Even in the first modified example and the second modified example, high-speed/large-volume millimeter-wave communication is established between signal processing modules 424 within the housing 427 of the different portable electronic device 420 by arranging the portable electronic device 420 on the mounting surface of the cradle device 400.

Further, it is preferred to perform coupling in longitudinal waves using an antenna having vertical directivity, in that electromagnetic coupling of a high-frequency signal to the high-frequency signal waveguide 408 is accomplished as a high-frequency signal coupling structure of the signal processing module 424. It is possible to perform coupling of longitudinal electromagnetic waves and perform coupling only when contact is made. For example, a patch antenna or a slot antenna is provided so that its radiation surface is directed to the side of the cradle device 400. In the case of the patch antenna, it is only necessary to form a pattern of a conductor (metal) in a predetermined shape by plating the surface of a sealing resin of a semiconductor chip, pasting and etching a conductor plate, or putting a seal on which a metal pattern has been formed. In the case of the slot antenna, a waveguide structure using slot coupling or the like is provided, that is, by the application of a small aperture-coupled element, an antenna structure is caused to function as a coupling portion of the waveguide.

Incidentally, as in a third modified example illustrated in FIG. 12(C), electromagnetic coupling between the high-frequency signal waveguide 428 of the side of the portable electronic device 420 and the communication device 405 is considered when the high-frequency signal waveguide is arranged on the side of the portable electronic device 420, a large number of communication devices 405 are arranged on the circuit substrate 409 on the side of the cradle device 400_60, and the portable electronic device 420_60 or 420_61 is mounted. However, this case is not a good idea because there is a drawback in that the cost of the communication device 405 is increased and it is necessary to control setting of a communication device 405 which actually performs communication.

Although the case in which a linear or plate-like high-frequency signal waveguide is arranged in the cradle device 400 and/or the portable electronic device 420 has been described in the above-described first to third modified examples, this is not the only case. For example, it is possible to set a flexible sheet-like cradle device 400_70 having the high-frequency signal waveguide 408 with a two-dimensional communication function using a flexible dielectric material such as a flexible printed substrate as in a fourth modified example illustrated in FIG. 13. FIG. 13(A) illustrates a state in which the cradle device 400_70 (high-frequency signal waveguide 408) has been bent, and FIG. 13(B) illustrates a state in which the cradle device 400_70 (high-frequency signal waveguide 408) has been extended.

The cradle device 400_70 of the fourth modified example is embedded in a base material 403 formed of a flexible dielectric material, and its mounting surface side is covered with a sealing material 404 formed of a flexible dielectric material. The base material 403 may be a multilayer structure. A large number of openings 404*a* are provided on part of the sealing material 404. A dielectric material constituting the high-frequency signal waveguide 408 is also embedded in part of an opening 404*a*, and the high-frequency signal waveguide 408 is exposed via the opening 404*a*. It is possible to confine and transmit a high-frequency signal within the high-frequency signal waveguide 408 using one having a larger dielectric constant than the dielectric materials constituting the base material 403 and the sealing material 404.

Also, it is possible to efficiently and conveniently perform highly confidential communication via the high-frequency signal waveguide 408 without affecting an external device by placing the communication device (in other words, the portable electric device 420) having the high-frequency coupler in an arbitrary place (preferably, a portion of an opening 403*a*) on the high-frequency signal waveguide 408.

Example Application

Figure 14:
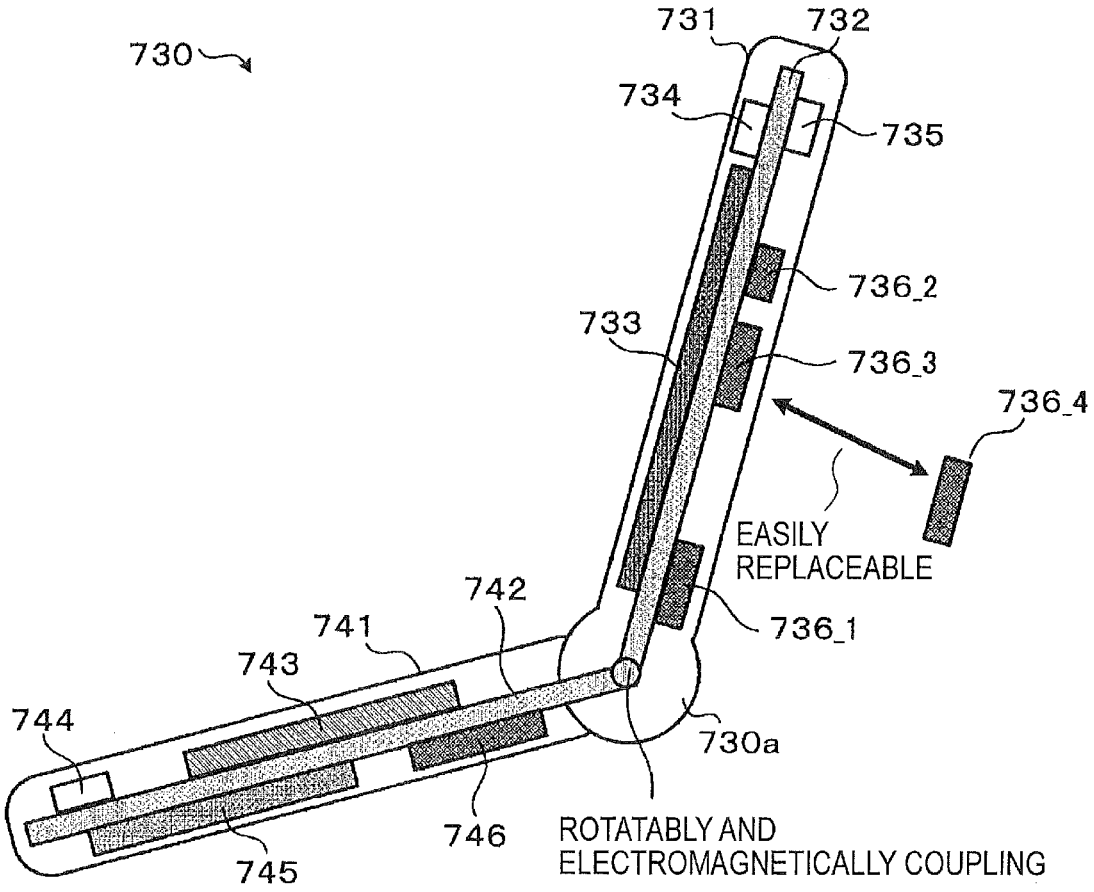
FIG. 14 is a diagram illustrating an example application 1 of another electronic device to which technology proposed in the present disclosure is applied.
Figure 15:
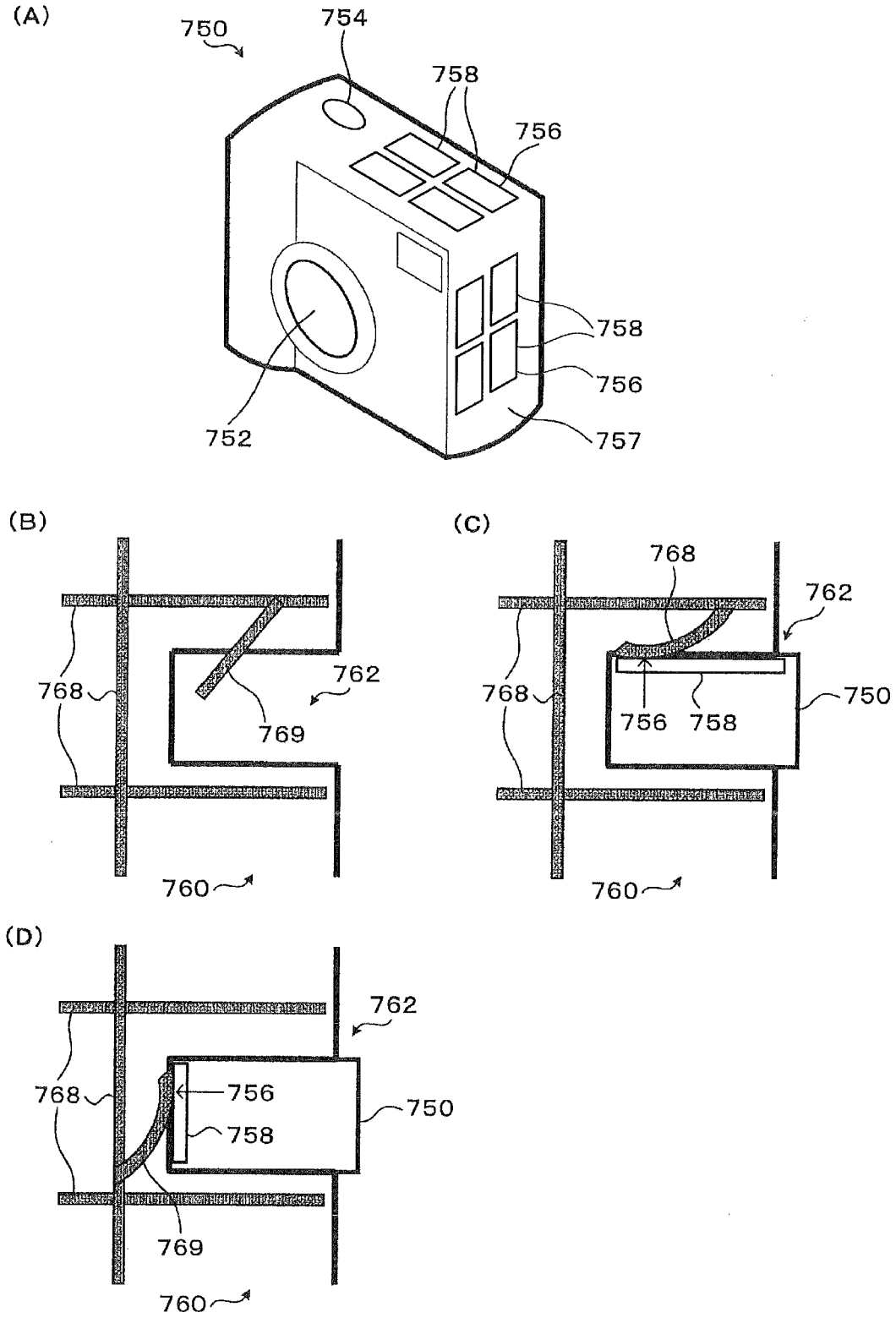
FIGS. 15(A) to 15(D) are diagrams illustrating an example application 2 of another electronic device to which technology proposed in the present disclosure is applied.
Figure 16:
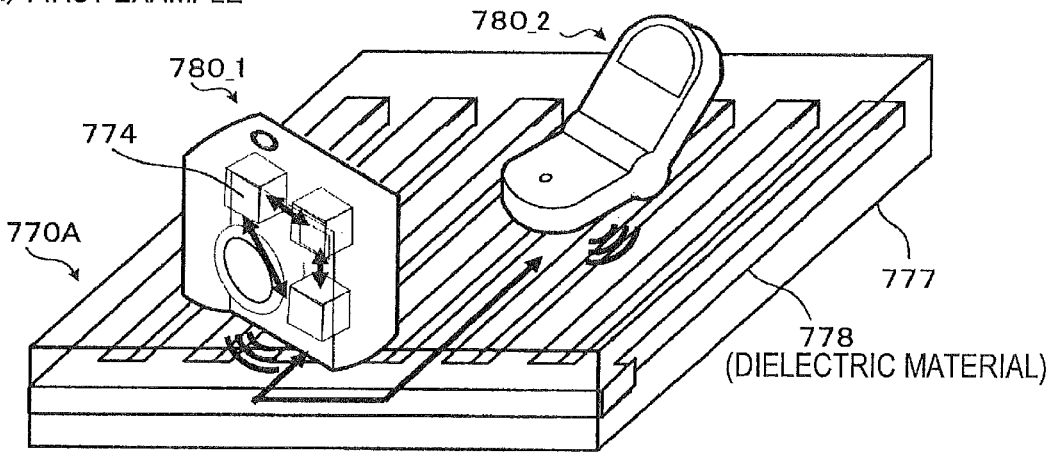
FIGS. 16(A) to 16(C) are diagrams illustrating an example application 3 of another electronic device to which technology proposed in the present disclosure is applied.
Figure 16:
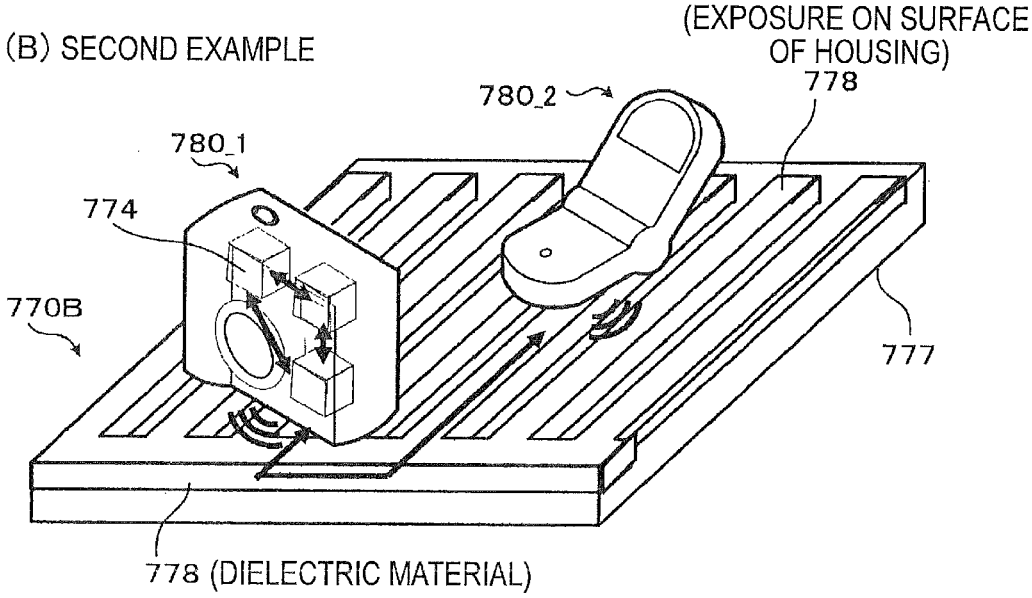
Figure 16:
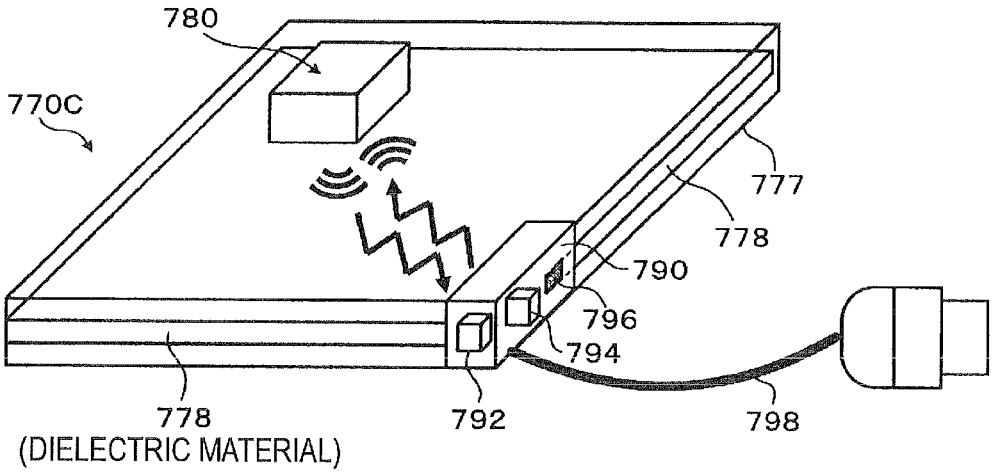

FIGS. 14 to 16 are diagrams illustrating an example of another electronic device to which technology proposed in the present disclosure (technology proposed in the above-described embodiment) is applied. The technology of the signal transmission device or the electronic device proposed in the above-described embodiment can be applied when a high-frequency signal is transmitted in various electronic devices such as a game machine, an electronic book, an electronic dictionary, a portable phone, and a digital camera. Hereinafter, specific examples of various devices to which the signal transmission device or the electronic device described in the above-described embodiment is applied will be described.

Example Application 1

Portable Phone

For example, it is possible to increase the number of functions by preparing a large number of throttles in which a signal processing module is installed and inserting a signal processing module having a certain function. Thereby, the exchange of the signal processing module is easily performed and function extension or repair is easily performed.

For example, FIG. 14 is a diagram illustrating the case in which the electronic device is a portable phone 730. The portable phone 730 is of a folding type, and an upper-side housing 731 and a lower-side housing 741 are coupled to be foldable by a connection portion 730*a* (a hinge portion in this example). A high-frequency signal waveguide 732 is arranged on the upper-side housing 731. On one surface of the high-frequency signal waveguide 732, a display module 733 using a liquid crystal display device, an organic electroluminescence (EL) display device, or the like and a speaker 734 is installed. On the other surface of the high-frequency signal waveguide 732, a camera module 735 and various semiconductor ICs 736 (for example, a baseband IC 736_1, a memory 736_2, and a CPU 736_3 are installed. In the lower-side housing 741, a high-frequency signal waveguide 742 is arranged. The high-frequency signal waveguides 732 and 742 are electromagnetically coupled to be foldable by the connection portion 730*a* (for example, to be rotatable in contact). On one surface of the high-frequency signal waveguide 742, an input key 743 and a microphone 744 are installed. On the other surface of the high-frequency signal waveguide 742, a battery 745 and a wireless circuit 746 are installed.

A throttle is configured for the upper-side housing 731 at a position at which the semiconductor IC 736 is arranged on the high-frequency signal waveguide 732. In the semiconductor IC 736, a high-frequency transceiver function is provided. For example, the high-frequency transceiver function is provided in the CPU 736_3. As understood from the description of the above-described embodiment, a high-frequency signal can be coupled by placing the CPU 736_3 in which a high-frequency transceiver is embedded on the high-frequency signal waveguide 732. By removing the CPU 736_3 and inserting another CPU 736_4 via the throttle, an exchange is easily possible and function extension or repair is easily performed.

Example Application

Throttle Structure

For example, if a slot structure to which a first electronic device having a signal processing module with a high-frequency transceiver function is attachable is prepared in a housing of a second electronic device serving as a main body side, it is possible to exchange data with the main body side by inserting the first electronic device having a certain function into the slot structure, and to change a function of a second electronic device by handling the first electronic device as an external device of the second electronic device. Either of the embodiment 4 and the embodiment 5 may be adopted as the slot structure. Hereinafter, the case in which the embodiment 5 is adopted will be described.

For example, FIG. 15 is a diagram illustrating the case in which the first electronic device is a digital camera having an attachable/detachable image storage memory. As illustrated in FIG. 15(A), a digital camera 750, a lens 752, a shutter button 754, and other parts are included. As illustrated in FIGS. 15(A) and 15(C), a high-frequency signal waveguide 758 is arranged in the digital camera 750, and one or more signal processing modules (not illustrated) having a high-frequency transmission/reception function are installed on the high-frequency signal waveguide 758. In part of the wall surface of the housing 757 of the digital camera 750, a portion (referred to as a slot 756) in which part of the high-frequency signal waveguide 758 is exposed is provided at one or more positions (four positions on the upper surface and four positions on the side surface in the drawing).

As illustrated in FIGS. 15(B) and 15(C), a slot structure 762 is provided in the electronic device 760 of the main body side and a high-frequency signal waveguide 768 is arranged within the housing. On the high-frequency signal waveguide 768, one or more signal processing modules (not illustrated) having a high-frequency transmission/reception function are installed. The flexible high-frequency signal waveguide 769 is attached to the high-frequency signal waveguide 768 so that its tip end side projects to a concave side of the slot structure 762.

As illustrated in FIG. 15(C), when the digital camera 750 serving as the configuration change unit is inserted into the slot structure 762, the high-frequency signal waveguide 769 is bent and comes in contact with the high-frequency signal waveguide 758 exposed in the slot 756 arranged on the upper-surface side of the digital camera 750. Thereby, communication of a high-frequency signal transmitted over a high-frequency signal waveguide between the signal processing module of the digital camera 750 and the signal processing module of the electronic device 760 of the main body side is established.

Because there are a plurality of electromagnetic coupling positions if the slot 756 is provided at a plurality of positions on one wall side of the housing 757 of the digital camera 750, electromagnetic coupling can be reliably performed. Also, if the slot 756 is provided at one or more positions on each of a plurality of wall surfaces of the housing 757 of the digital camera 750, a degree of freedom of a combination with the electronic device 760 of the main body side is increased. For example, an attachment position of the high-frequency signal waveguide 769 as illustrated in FIG. 15(D) may be different from those illustrated in FIGS. 15(B) and 15(C). When the digital camera 750 serving as the configuration change unit is inserted into the slot structure 762, the high-frequency signal waveguide 769 is bent and comes in contact with the high-frequency signal waveguide 758 exposed in the slot 756 arranged on the side-surface side of the digital camera 750.

Example Application 3

Cradle

By applying the embodiment 6, it is possible to establish communication of a high-frequency signal between electronic devices arranged on the cradle device. For example, in FIG. 16, a first electronic device is a cradle device 770, and a portable electronic device 780 such as a portable phone, a personal handy-phone system (PHS), or a digital camera, can be installed on a mounting surface of the cradle device 770. Preferably, on the mounting surface, an addition unit representing a position of an adjacent arrangement for a function change may be clearly recognized. For example, a concave portion may be provided on the mounting surface side, and the high-frequency signal waveguide 778 may be provided along its bottom surface (within the housing). Alternatively, a position of a proximity arrangement for a function change may be indicated (marked) in a state in which the mounting surface side is flat.

In the first example illustrated in FIG. 16(A), in a cradle device 770A, a transmission path of the high-frequency signal waveguide 778 serving as a high-frequency coupler, which relays (couples) transmission of a high-frequency signal between signal processing modules, is arranged in a comb shape. The dielectric material of the high-frequency signal waveguide 778 has a larger dielectric constant than the air, so that the high-frequency signal can be confined and transmitted within the high-frequency signal waveguide 778. Material quality, width, and thickness of a dielectric material of the high-frequency signal waveguide 778 are determined according to a used frequency. Because the width of the waveguide can also be adjusted as compared to a plate- or band-like transmission path as in the above-described third example, there is an advantage in that a structure having good coupling or minor loss is created. The high-frequency signal waveguide 778 is fully housed within a housing 777. The cradle device 770A does not include a central control unit which controls each electronic device 780 by sensing that the electronic device 780 has been mounted on the mounting surface, and controls communication between the electronic devices 780.

Preferably, each surface excluding the mounting-surface side of the high-frequency signal waveguide 778 may be surrounded with a shielding material (preferably, a metal member including metal plating is used) so that there is no influence of unnecessary electromagnetic waves from outside and no high-frequency signal leakage from inside. Because the metal member functions as a reflecting material when used as the shielding material, a reflected component is used, so that reflected waves can be used for transmission/reception and sensitivity is improved. However, there may be a problem in that unnecessary standing waves occur within the high-frequency signal transmission path 778 due to multi-reflection within the high-frequency signal transmission path 778. In order to avoid this problem, the periphery (an upper surface, a lower surface, and a side surface) of the high-frequency signal transmission path 778 may remain open and an absorbing member (radio-wave absorbing body), which absorbs a high-frequency signal, may be arranged. Although it is difficult to use the reflected waves for transmission/reception when a radio-wave absorbing body is used, radio waves leaked from an end surface can be absorbed, so that leakage to an outside can be prevented and a multi-reflection level within the high-frequency signal transmission path 778 can be decreased. These points are also the same as in second and third examples, described later.

On the other hand, one electronic device 780_1 is a digital camera, a high-frequency signal waveguide (not illustrated) is arranged in the digital camera, and one or more signal processing modules 784 having a high-frequency transmission/reception function are installed on the high-frequency signal waveguide. The other electronic device 780_2 is a portable phone, a high-frequency signal waveguide is arranged, although not illustrated, and one or more signal processing modules and a wireless circuit (not illustrated) having a high-frequency transmission/reception function are installed on the high-frequency signal waveguide.

The one electronic device 780_1 (digital camera) and the other electronic device 780_2 (portable phone) are mounted on the cradle device 770A, and image data inside the digital camera is transmitted to the portable phone via the cradle device 770A by operating any one of the electronic device 780_1 and the electronic device 780_2. Thereby, it is possible to implement a function of transmitting image data acquired by the digital camera via a portable phone (in other words, a communication line, a wireless local area network (WLAN), or the like).

Although the second example illustrated in FIG. 16(B) is schematically similar to the first example illustrated in FIG. 16(A), a surface of a transmission path arranged in a comb shape of the high-frequency signal waveguide 778 is exposed from the housing 777 in the second example. A gap between transmission paths arranged in the comb shape is filled with a dielectric material constituting the housing 777 of a cradle device 770B. That is, the high-frequency signal waveguide 778 is embedded in another dielectric material having a different dielectric constant. The dielectric material of the high-frequency signal waveguide 778 is set to have a larger dielectric constant than a dielectric material constituting the housing 777, so that a high-frequency signal can be confined and transmitted within the high-frequency signal waveguide 778. Based on a time difference due to a path difference based on a position of a comb tooth, it is possible to recognize a comb teeth position at which the electronic device 780 (or a foreign object) has been placed.

Further, it is preferred for a communicable area of a high-frequency signal coupling structure of the side of the electronic device 780 not to step over an adjacent comb tooth even in the first example and the second example. Because a plurality of paths having a path difference for a gap between comb teeth are formed if the communicable area steps over the adjacent tooth, interference with a signal passing through a different path is formed and a negative effect due to a multipath phenomenon is likely to result. These points are common when there is a concern that the communicable area steps over an adjacent transmission path, and are similar, for example, even when the transmission path has a lattice shape, a spiral shape, or the like.

For example, if "$DT<W+w$" is given when a communicable width is DT, a comb tooth width is W, and a gap between adjacent comb teeth is w, it is possible to reliably prevent the communicable width DT from stepping over an adjacent comb tooth.

In the case of "$DT\geq W+w$," action can be taken by performing data transmission at a preferable level based on a reception signal level when the electronic device 780 is placed on the cradle device 770 using relative movement that substantially surely occurs at the time of mounting. Alternatively, an operator may be prompted to finely adjust a mounting position of the electronic device 780 using a sound, a light emitting diode (LED) indication, or the like so that a reception signal is at a preferable level. It is only necessary for the central control unit provided in at least one of the electronic devices 780 to be responsible for these functions. Of course, when the central control unit is provided in the cradle device 770, it is only necessary for its central control unit to be responsible for the functions.

In the third example illustrated in FIG. 16(C), the high-frequency signal waveguide 778 is created by one dielectric plate, and a plate- or band-like transmission path is formed. A dielectric material of the high-frequency signal waveguide 778 has a larger dielectric constant than the air, so that it is possible to confine and transmit a high-frequency signal within the high-frequency signal waveguide 778. Material quality or a thickness of the high-frequency signal waveguide 778 is determined according to a used frequency. Although not illustrated, the high-frequency signal waveguide 778 may have transmission paths arranged in the comb shape as in the first example illustrated in FIG. 16(A), and may be embedded in another dielectric material having a different dielectric constant as in the second example illustrated in FIG. 16(B). The high-frequency signal waveguide 778 is fully housed within the housing 777. A communication device 790, which performs data transmission/reception, is attached to part of a side surface excluding an upper surface and a lower surface in the high-frequency signal waveguide 778. The communication device 790 is further connected to a server device (not illustrated) via a connection wiring 798. The communication device 790 may be arranged at one or more positions. Also, multi-input multi-output (MIMO) may be applied using communication devices 790 at a plurality of positions. Each electronic device 780 is controlled by sensing that the electronic device 780 has been mounted on the mounting surface, and a central control unit, which controls communication between the electronic devices 780, is provided in a server device instead of a cradle device 770C. It is only necessary for connection specs of the connection wiring 798 to those of a standard corresponding to high-speed data transmission. For example, USB, Institute of Electrical and Electronics Engineers (IEEE) 1394, and the like can be adopted.

The communication device 790 has a transmission/reception circuit unit 792 having a transmission circuit unit and a reception circuit unit, a resonance unit 794, and a transmission/reception electrode 796. The transmission/reception electrode 796 is attached to an end surface of the high-frequency signal waveguide 778. A high-frequency coupler, which couples a high-frequency signal in the end surface of the high-frequency signal waveguide 778, is formed by the resonance unit 794 and the transmission/reception electrode 796. Incidentally, although the attachment to a corner portion of the high-frequency signal waveguide 778 is illustrated in the drawing, the present disclosure is not limited thereto. However, it is desirable to arrange the end surface of the high-frequency signal waveguide 778 to be substantially perpendicular to an electrode surface on the front surface of the transmission/reception electrode 796 because an incidence angle of surface waves radiated from the transmission/reception electrode 796 (or an incidence angle of surface waves incident on the transmission/reception electrode 796) is increased and a ratio at which transmitted waves are radiated outside is decreased.

When a transmission request is generated from a higher-order application of a server device side, the transmission circuit unit of the transmission/reception circuit unit 792 generates a high-frequency transmission signal based on transmission data. A high-frequency transmission signal output from the transmission circuit unit resonates in the resonance unit 794, is radiated as surface waves in a forward direction from the transmission/reception electrode 796, and propagates within the high-frequency signal waveguide 778. A high-frequency transmission signal output from the electronic device 780 also propagates within the high-frequency signal waveguide 778 as surface waves. The reception circuit unit of the transmission/reception circuit unit 782 performs a demodulation and decoding process on a high-frequency signal received by the transmission/reception electrode 786, and reproduced data is delivered to a high-order application of the server device side. Within the high-frequency signal waveguide 778, reflection is iterated every time surface waves reach a boundary surface with an outside, and the surface waves propagate without loss. Therefore, a high-frequency signal of millimeter waves or the like efficiently propagate through the high-frequency signal waveguide 778.

Although the technology disclosed in this specification has been described above using the embodiments, the technical scope of the contents described in the appended claims is not limited to the scope of the description of the above-described embodiments. Various changes and improvements can be made in the above-described embodiments without departing from the subject matter of the technology disclosed in this specification, and forms in which such changes and improvements are made are also contained within the technical scope of the technology disclosed in this specification. The above-described embodiments do not limit the technology according to the claims, and all of combinations of the features described in the embodiments are not indispensable for solving the problems that the technology disclosed in this specification is to solve. Various stages of technology are contained in the above-described embodiments and a variety of technology can be extracted based on suitable combinations in a plurality of disclosed constituent requirements. Even when some among the configuration requirements described in the embodiments are deleted, the resulting configurations can also be implemented as technology described in this specification, as long as the effects corresponding to the problems to be solved by the technology disclosed in this specification are obtained.

REFERENCE SIGNS LIST

300 electronic device
302 central control unit
304 existing signal processing module
306 configuration change signal processing module
308 high-frequency signal waveguide
320 signal processing module
332 high-frequency signal waveguide
342 high-frequency signal coupling structure
358 connection high-frequency signal waveguide
360 slot structure
400 cradle device
402 central control unit
408 high-frequency signal waveguide
420 portable electronic device
424 signal processing module
428 high-frequency signal waveguide
429 high-frequency signal coupling structure

The invention claimed is:

1. An electronic device comprising:

at least one high-frequency signal waveguide to transmit a high-frequency signal;

an addition unit coupled to the at least one high-frequency signal waveguide, the addition unit coupling to the at least one high-frequency signal waveguide a first module including a first communication function;

a control unit that (a) recognizes coupling of the first module to the at least one high-frequency signal waveguide, and (b) controls data transmission over the at least one high-frequency waveguide according to the first communication function; and a slot structure into which another electronic device is able to be inserted, wherein, the at least one high-frequency signal waveguide is arranged parallel to a wall surface of the slot structure, and when the other electronic device is inserted into the slot structure, data transmission to and from the other electronic device occurs via the at least one high-frequency signal waveguide.

2. The electronic device according to claim 1, wherein, when the first module having the first communication function is coupled to the at least one high-frequency signal waveguide, data transmission occurs between the first module and a second module having a second communication function also coupled to the at least one high-frequency signal waveguide.

3. The electronic device according to claim 1, comprising a plurality of high-frequency signal waveguides, wherein, when the first module is coupled to the at least one high-frequency signal waveguide, data transmission occurs between the first module and a second module having a second communication function via the at least one of the plurality of high-frequency signal waveguides, independently of the other high-frequency signal waveguides.

4. The electronic device according to claim 1, comprising:

a plurality of high-frequency signal waveguides; and a connection high-frequency signal waveguide configured to connect the plurality of high-frequency signal waveguides, wherein, when the first module having the first communication function is added to the addition unit, data transmission occurs between the first module and a second module, having a second communication function and coupled to at least one of the plurality of high-frequency signal waveguides, via the plurality of high-frequency signal waveguides and the connection high-frequency signal waveguide.

5. The electronic device according to claim 4, wherein the connection high-frequency signal waveguide is attachable to and detachable from the plurality of high-frequency signal waveguides.

6. The electronic device according to claim 2, wherein the first module is a configuration change module.

7. The electronic device according to claim 1, wherein the at least one high-frequency signal waveguide is arranged along a housing.

8. The electronic device according to claim 1, wherein, when another electronic device is arranged close to the at least one high-frequency signal waveguide, the other electronic device transmits data via the at least one high-frequency signal waveguide.

9. The electronic device according to claim 8, wherein, when a plurality of other electronic devices are arranged close to the at least one high-frequency signal waveguide, data transmission occurs among the plurality of other electronic devices.

10. The electronic device according to claim 8, wherein when another electronic device is arranged close to the at least one high-frequency signal waveguide, data transmission occurs between the first module, having the first communication function, and the other electronic device.

11. The electronic device according to claim 1, wherein at least a part of the at least one high-frequency signal waveguide is exposed from a housing.

12. The electronic device according to claim 11, wherein:

the at least one high-frequency signal waveguide is exposed from a housing, and when a high-frequency signal waveguide of another electronic device is in contact with the exposed at least one high-frequency signal waveguide of the electronic device, data transmission occurs.

13. The electronic device according to claim 1, wherein the control unit is arranged external to the electronic device .

14. The electronic device according to claim 1, wherein the control unit senses where the first module is arranged in the at least one high-frequency signal waveguide.

15. The electronic device according to claim 1, wherein the control unit senses whether the first module having the first communication function has been arranged on the at least one high-frequency signal waveguide.

16. An electronic device comprising:

at least one high-frequency signal waveguide configured to transmit a high-frequency signal;

an addition unit coupled to the at least one high-frequency signal waveguide, the addition unit coupling to the waveguide a first module including a first communication function; and a control unit that (a) recognizes the addition coupling of the first module to the waveguide, and (b) controls data transmission over the at least one high-frequency waveguide according to the communication function; and a slot structure into which another electronic device is able to be inserted, wherein, the at least one high-frequency signal waveguide has a flexible end projecting into the slot structure, and when the other electronic device is inserted into the slot structure and comes in contact with the end of the at least one high-frequency signal waveguide, data transmission to and from the other electronic device occurs.

17. A module capable of being coupled to at least one high-frequency signal waveguide configured to transmit a high-frequency signal, the module comprising:

a communication device; and a transfer structure configured to cause the high-frequency signal emitted from the communication device to be coupled to the at least one high-frequency signal waveguide of an electronic device having a control unit that (a) recognizes the communication device, and (b) controls data transmission over the at least one high-frequency waveguide according to a configuration of the communication device.

* * * * *